US008231193B2

(12) United States Patent
Nakamura et al.

(10) Patent No.: US 8,231,193 B2
(45) Date of Patent: Jul. 31, 2012

(54) IMAGE RECORDING APPARATUS AND INFORMATION OUTPUT METHOD

(75) Inventors: Hirotake Nakamura, Nagoya (JP); Hiroaki Yazawa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 839 days.

(21) Appl. No.: 12/325,632

(22) Filed: Dec. 1, 2008

(65) Prior Publication Data

US 2009/0141056 A1 Jun. 4, 2009

(30) Foreign Application Priority Data

Nov. 30, 2007 (JP) ..... 2007-310362

(51) Int. Cl.
*B41J 2/195* (2006.01)

(52) U.S. Cl. ..... 347/7; 347/19; 347/84

(58) Field of Classification Search ..... None
See application file for complete search history.

(56) References Cited

U.S. PATENT DOCUMENTS

| | | | | |
|---|---|---|---|---|
| 5,329,294 | A * | 7/1994 | Ontawar et al. | 347/87 |
| 6,672,695 | B1 * | 1/2004 | Naka et al. | 347/7 |
| 7,278,722 | B2 | 10/2007 | Sasaki et al. | |
| 7,325,913 | B2 | 2/2008 | Sasaki et al. | |
| 7,334,888 | B2 | 2/2008 | Sasaki et al. | |
| 7,334,889 | B2 | 2/2008 | Sasaki et al. | |
| 7,350,909 | B2 | 4/2008 | Takagi et al. | |
| 7,384,136 | B2 | 6/2008 | Takagi et al. | |
| 2006/0001717 | A1 | 1/2006 | Sasaki et al. | |
| 2007/0273736 | A1 | 11/2007 | Sasaki et al. | |

FOREIGN PATENT DOCUMENTS

| | | |
|---|---|---|
| JP | 7266577 | 10/1995 |
| JP | 2001-105699 | 4/2004 |
| JP | 2005-41085 | 2/2005 |
| JP | 2005-254734 | 9/2005 |
| JP | 2007-001212 | 1/2007 |
| JP | 2007-030289 | 2/2007 |

* cited by examiner

*Primary Examiner* — Uyen Chau N Le
*Assistant Examiner* — Chad Smith
(74) *Attorney, Agent, or Firm* — Frommer Lawrence & Haug LLP

(57) ABSTRACT

An image recording apparatus and an information output method are provided. The image recording apparatus includes a mounting portion configured to mount thereon an ink cartridge, a first detecting unit which detects an amount of ink in the ink cartridge mounted on the mounting portion, a storage unit which stores a detection result by the first detecting unit in a storage medium, a comparing unit which compares a first detection result stored in the storage medium before the image recording apparatus is restarted, with a second detection result obtained by the first detecting unit after the image recording apparatus is restarted, and a first output unit which outputs instruction information to re-mount the ink cartridge if the comparing unit determines that the first detection result is not same as the second detection result.

11 Claims, 16 Drawing Sheets

IMAGE RECORDING APPARATUS AND INFORMATION OUTPUT METHOD

CROSS-REFERENCE TO RELATED APPLICATION

This application claims priority from Japanese Patent Application No. 2007-310362, filed on Nov. 30, 2007, the entire subject matter of which is incorporated herein by reference.

TECHNICAL FIELD

Aspects of the present invention relate to an ink-jet image recording apparatus configured to mount thereon an ink cartridge having ink stored therein and an information output method of outputting predetermined information.

BACKGROUND

Ink-jet recording apparatuses use ink to record images on a sheet (recording medium) (hereinafter, referred to as 'image recording apparatuses'). The recording apparatus includes a mounting portion mount thereon an ink cartridge. The ink cartridge is provided so as to be mounted on or removed from the mounting portion. When ink is supplied from the ink cartridge to a recording head, the recording head selectively discharges ink from nozzles to the sheet. In this way, an image is recorded on the sheet.

JP-A-2005-254734 describes this type of recording apparatus, which is capable of detecting whether an ink cartridge is mounted on a mounting portion or detecting the amount of ink in the mounted ink cartridge. In addition, JP-A-7-266577 describes a recording apparatus which, when an ink cartridge is replaced with the recording apparatus in an off state, is capable of recognizing the replacement of the ink cartridge after the recording apparatus is turned on. Further, JP-A-2005-41085 describes an image forming apparatus which stores information indicating whether an ink cartridge is mounted or removed in an off state, determines whether an ink cartridge, which has not been mounted in the off state, is mounted thereon after it is turned on, and supplies ink from the ink cartridge to a sub-tank if it is determined that the ink cartridge is mounted thereon.

However, in the recording apparatus having a function of detecting information (for example, information on the kind of ink cartridge, which is referred to as 'related information') related to an ink cartridge from the ink cartridge when the ink cartridge is mounted on the mounting portion, when the ink cartridge is replaced with a new one while the recording apparatus is in an off state due to, for example, cut-off of power supply, the recording apparatus cannot detect the related information after restart. In this case, it is difficult for the recording apparatus to correctly perform particular processes, for example, a process of monitoring the amount of ink according to the kind of ink cartridges on the basis of the related information.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image recording apparatus and an information output method capable of prompting a user to re-mount an ink cartridge after the apparatus is started up, even when the ink cartridge has been replaced with a new one, in an off state of the apparatus.

According to an exemplary embodiment of the present invention, there is provided an image recording apparatus including: a mounting portion configured to mount thereon an ink cartridge; a first detecting unit which detects an amount of ink in the ink cartridge mounted on the mounting portion; a storage unit which stores a detection result by the first detecting unit in a storage medium; a comparing unit which compares a first detection result stored in the storage medium before the image recording apparatus is restarted, with a second detection result obtained by the first detecting unit after the image recording apparatus is restarted; and a first output unit which outputs instruction information to re-mount the ink cartridge if the comparing unit determines that the first detection result is not same as the second detection result.

According to another exemplary embodiment of the present invention, there is provided an information output method including: detecting an amount of ink in an ink cartridge which is removably mountable on an image recording apparatus; storing the detected amount of ink in a storage medium; comparing a first detection result stored in the storage medium before the image recording apparatus is restarted, with a second detection result obtained at the detecting step after the image recording apparatus is restarted; and outputting instruction information to re-mount the ink cartridge if it is determined that the first detection result is not same as the second detection result.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 2A shows a slider disposed at a first position, and FIG. 2B shows the slider disposed at a second position;

FIG. 3A shows the slider disposed at the first position, and FIG. 3B shows the slider disposed at the second position;

FIG. 4A is a perspective view illustrating the body, as viewed from a front surface, and FIG. 4B is a perspective view illustrating the body, as viewed from a rear surface;

FIG. 6A is a perspective view illustrating the ink cartridge, and FIG. 6B is a side view illustrating the ink cartridge;

DETAILED DESCRIPTION

Hereinafter, illustrative non-limiting exemplary embodiments of the present invention will be described with reference to the accompanying drawings. It will be understood by those skilled in the art that various changes in form and details may be made therein without departing from the spirit and scope of the invention as defined by the appended claims.

[Multi-Function Machine 10]

Figure 1:
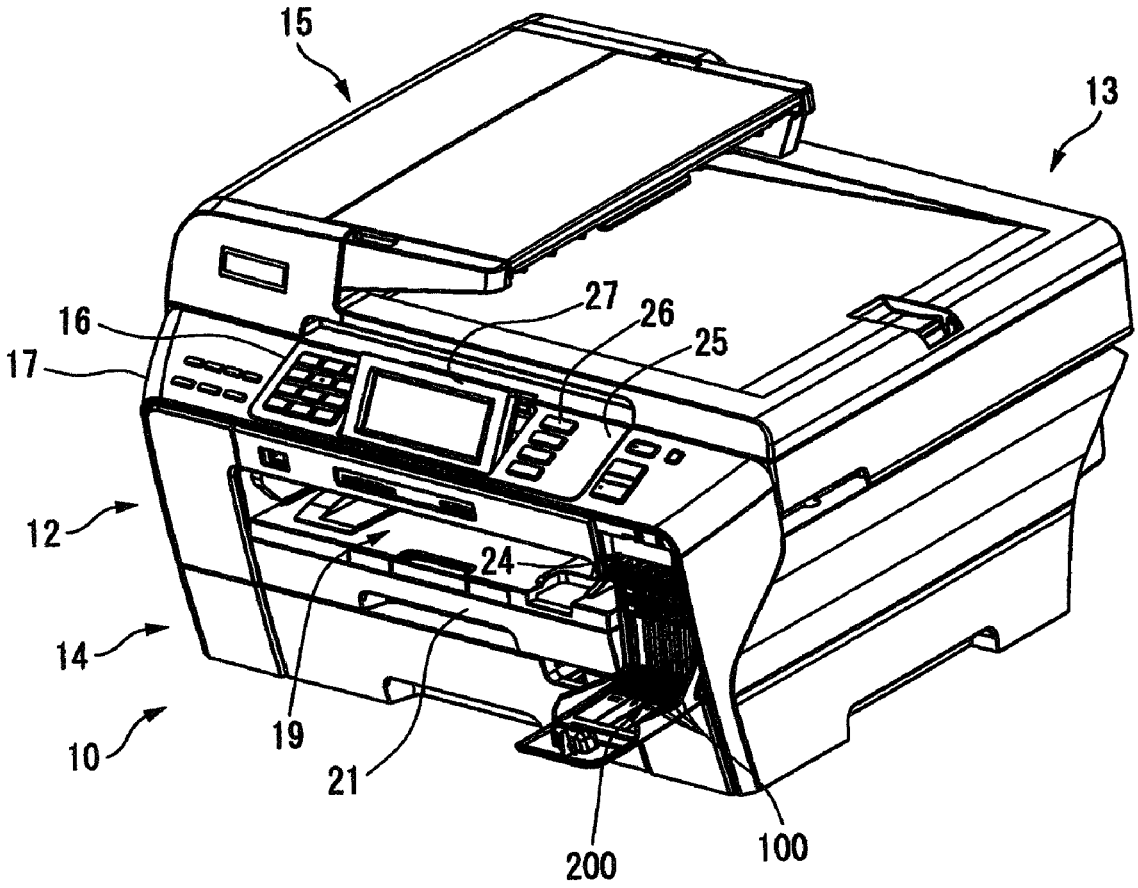
FIG. 1 is a perspective view illustrating the external configuration of a multi-function machine according to an exemplary embodiment.

The configuration of a multi-function machine 10 will be described with reference to FIG. 1. FIG. 1 is a perspective view illustrating the external configuration of the multi-function machine 10 according to an exemplary embodiment of the invention. FIG. 1 shows a state in which an ink cartridge 100 is mounted on (inserted into) a base unit 200.

The multi-function machine 10 includes an ink-jet printer unit 12 including a middle part, a scanner unit 13 provided at an upper part, an automatic document feeder (ADF) 15 which transports a document loaded on the scanner 13, and an extension tray 14 provided at a lower part. When print data is transmitted from a computer or an external recording apparatus connected to the multi-function machine 10 or the scanner unit 13 to the printer unit 12, the print unit 12 performs printing based on the print data.

As shown in FIG. 1, an opening 19 is formed in a case 17 of the printer unit 12. The opening 19 is formed in the vicinity of the center of the front surface of the case 17. A sheet feed tray 21 for accommodating sheets is inserted into the opening 19. A sheet discharge tray (not shown) is defined on the upper surface of the sheet feed tray 21, and printed sheets are discharged to the sheet discharge tray.

A control panel 16 which controls the operations of the print unit 12 and the scanner unit 13 is provided at an upper part of the front surface of the multi-function machine 10. A front surface 25 of the control panel 16 is inclined downward to the front side of the multi-function machine at a specific angle with respect to the horizontal plane. The control panel 16 includes a plurality of push switches 26 corresponding to various operations and a liquid crystal display 27 which displays various information items related to the multi-function machine 10. The liquid crystal display 27 is provided at the center of the front surface 25. The liquid crystal display 27 is movably held by a so-called tilt mechanism between a falling position that is parallel to the front surface 25 and a rising position that is vertical to the front surface 25. The plurality of push switches 26 are appropriately arranged on the left and right sides of the liquid crystal display 27. The multi-function machine 10 is operated on the basis of various instructions input from the control panel 16. When the multi-function machine 10 is connected to an external computer, the multi-function machine 10 is operated on the basis of instructions transmitted from the computer through a printer driver or a scanner driver.

An opening 24 is formed in the front surface of the case 17 in the vicinity of the right end in the width direction. The base unit 200 is provided inside the case 17 through the opening 24. As shown in FIG. 1, the base unit 200 is provided in the case 17 so as to be close to the front surface. The base unit 200 includes a cartridge mounting portion 202 (see FIG. 7). Ink cartridges 100 of various colors are supported by the cartridge mounting portion 202 such that they can be inserted into or removed from the cartridge mounting portion. In this exemplary embodiment, the cartridge mounting portion 202 capable of accommodating four ink cartridges 100 are provided in the base unit 200.

Each of the ink cartridges 100 stores ink that can be used by the printer unit 12. Specifically, color inks, such as cyan, magenta, yellow, and black inks, are stored in the corresponding ink cartridges 100. The color inks stored in the ink cartridges 100 are supplied to a recording head (not shown) through the base unit 200. The detailed configuration of the ink cartridge 100 and the base unit 200 will be described below.

Meanwhile, two kinds of ink cartridges 100 that store different amounts of ink of the same color are on the market. For example, an ink cartridge for a user who consumes a large amount of ink and a standard ink cartridge for a general user are on the market. The large capacity ink cartridge stores a large amount of ink at the beginning. That is, the amount of ink stored in the large capacity ink cartridge is larger than that stored in the standard ink cartridge. The standard ink cartridge stores a standard amount of ink at the beginning. That is, the amount of ink stored in the standard ink cartridge is smaller than that stored in the large capacity ink cartridge. In this exemplary embodiment, the large capacity ink cartridge is referred to as an ink cartridge 100A, and the standard ink cartridge is referred to as an ink cartridge 100B. In the multi-function machine 10, the two kinds of ink cartridges 100A and 100B and the base unit 200 are configured such that the ink cartridges 100A and 100B can be inserted into the cartridge mounting portion 202 of the base unit 200. In the following description, the ink cartridge 100A and ink cartridge 100B are generally referred to as the ink cartridge 100 if it is not necessary to discriminate the two kinds of ink cartridges.

In addition, the multi-function machine 10 has a function (kind determining function) of determining the kind of ink cartridge 100 inserted into the base unit 200. The kind determining function is implemented by a main control unit 250 (see FIG. 12) of the multi-function machine 10. The kind determining function will be described in detail later.

[Ink Cartridge 100A]

Figure 2B:
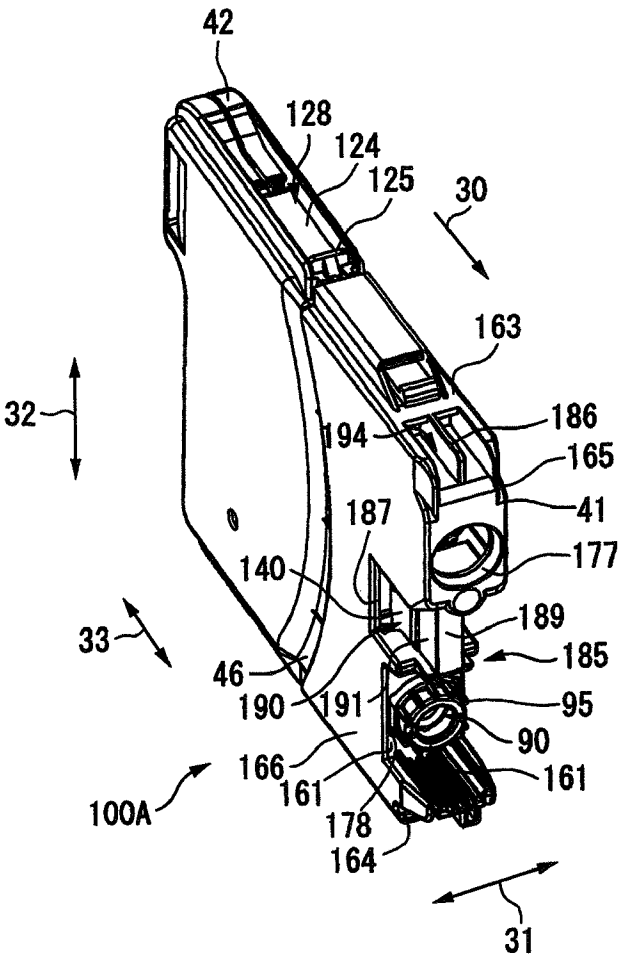
FIGS. 2A and 2B are perspectives view illustrating the external configuration of an ink cartridge according to an exemplary embodiment.
Figure 2A:
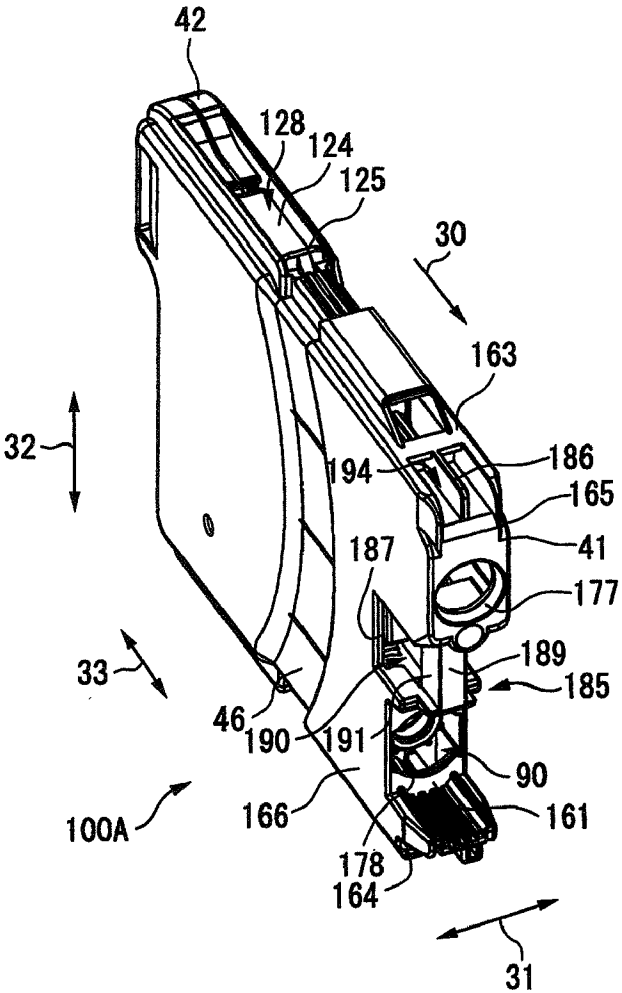
Figure 3A:
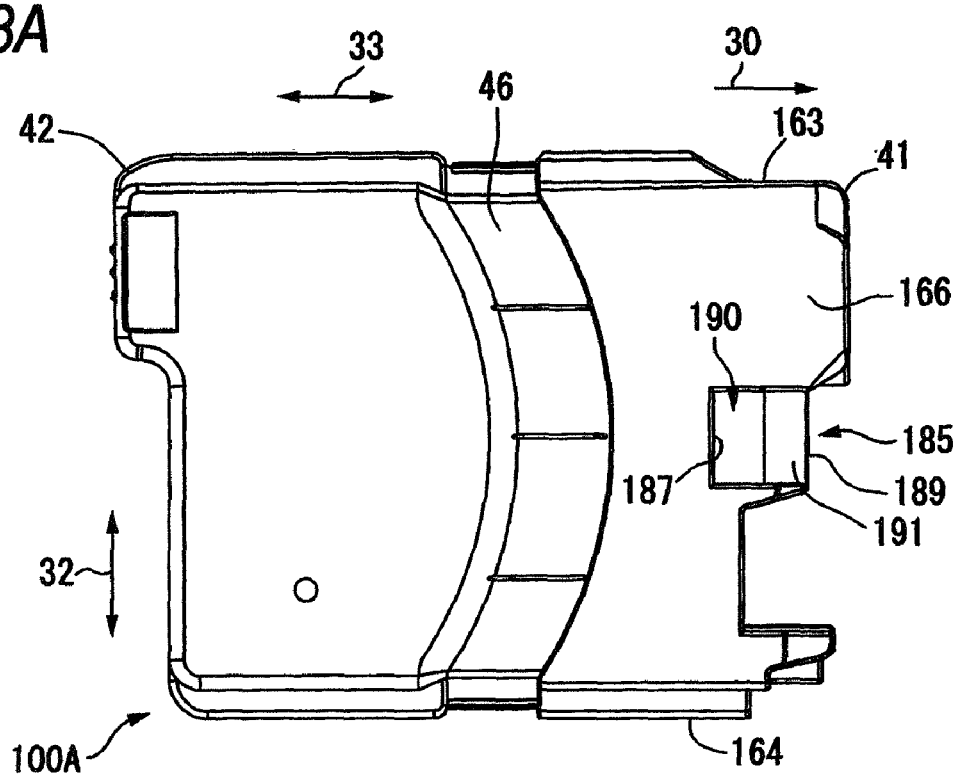
FIGS. 3A and 3B are side views illustrating the ink cartridge.
Figure 3B:
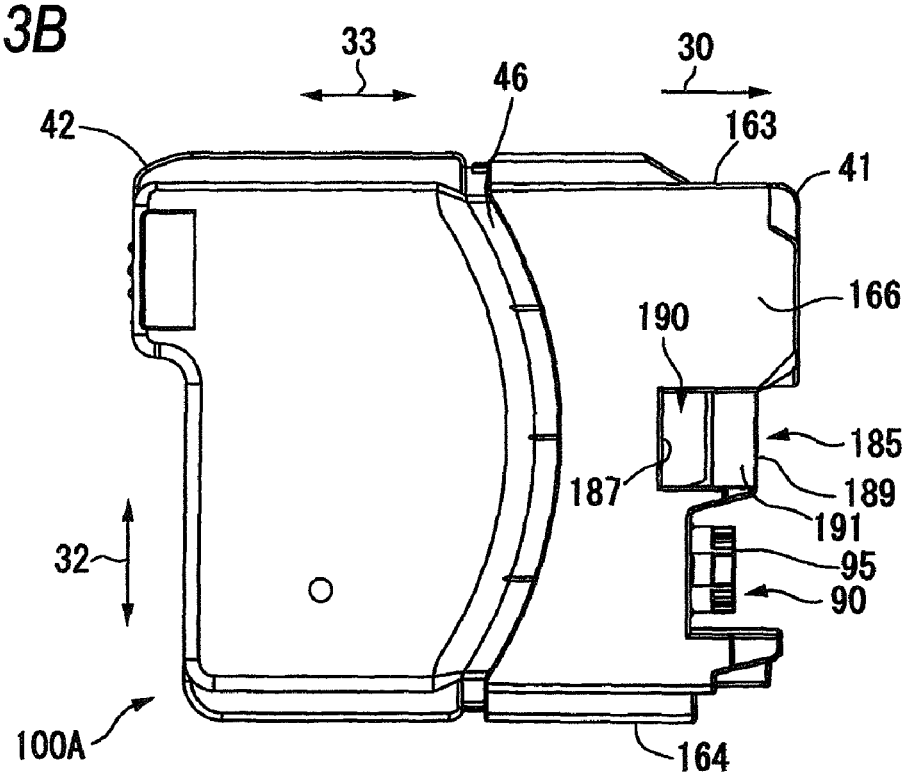
Figure 4B:
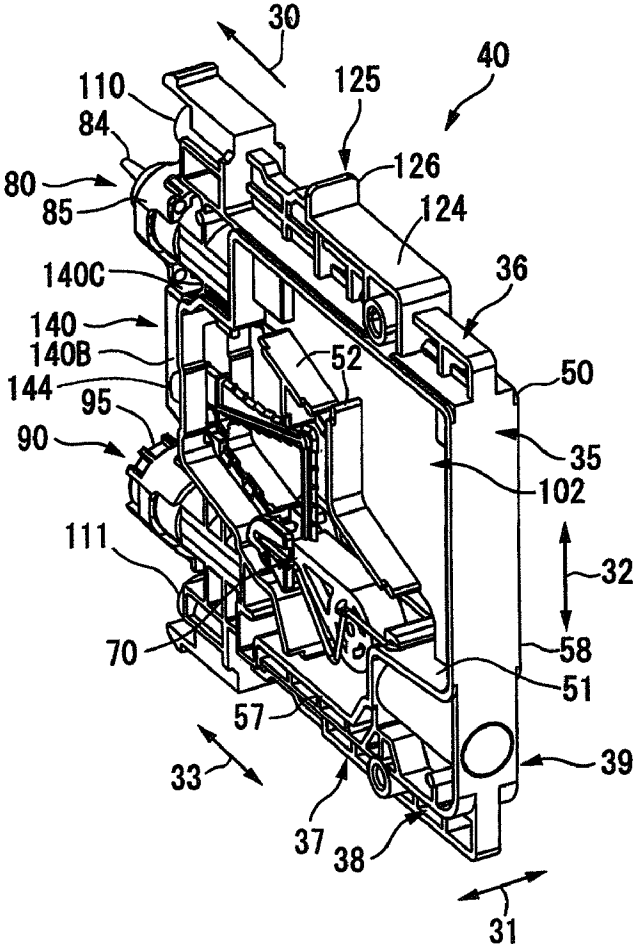
FIGS. 4A and 4B are perspective views illustrating the configuration of a body of the ink cartridge.
Figure 4A:
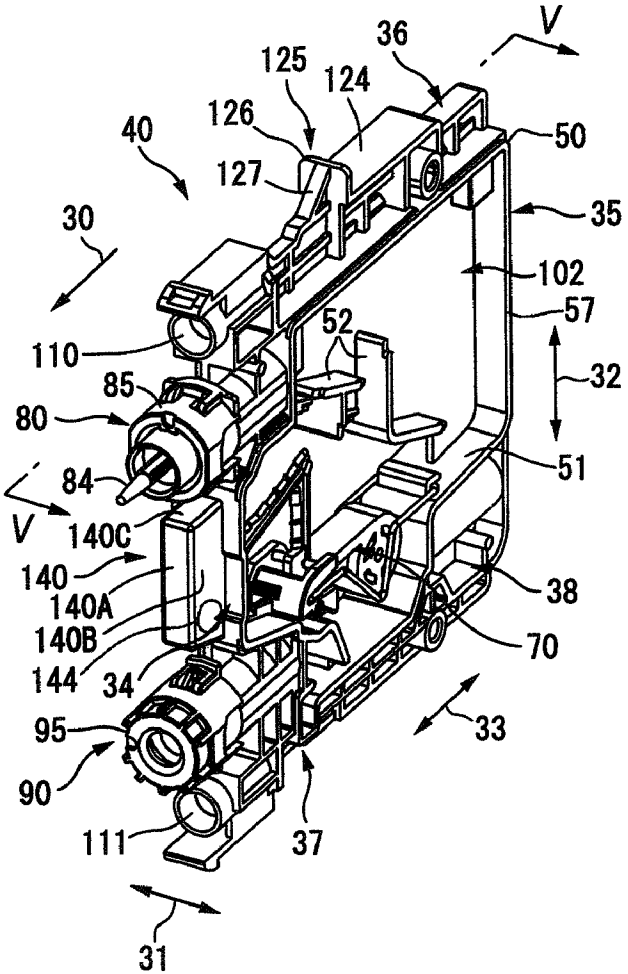
Figure 5:
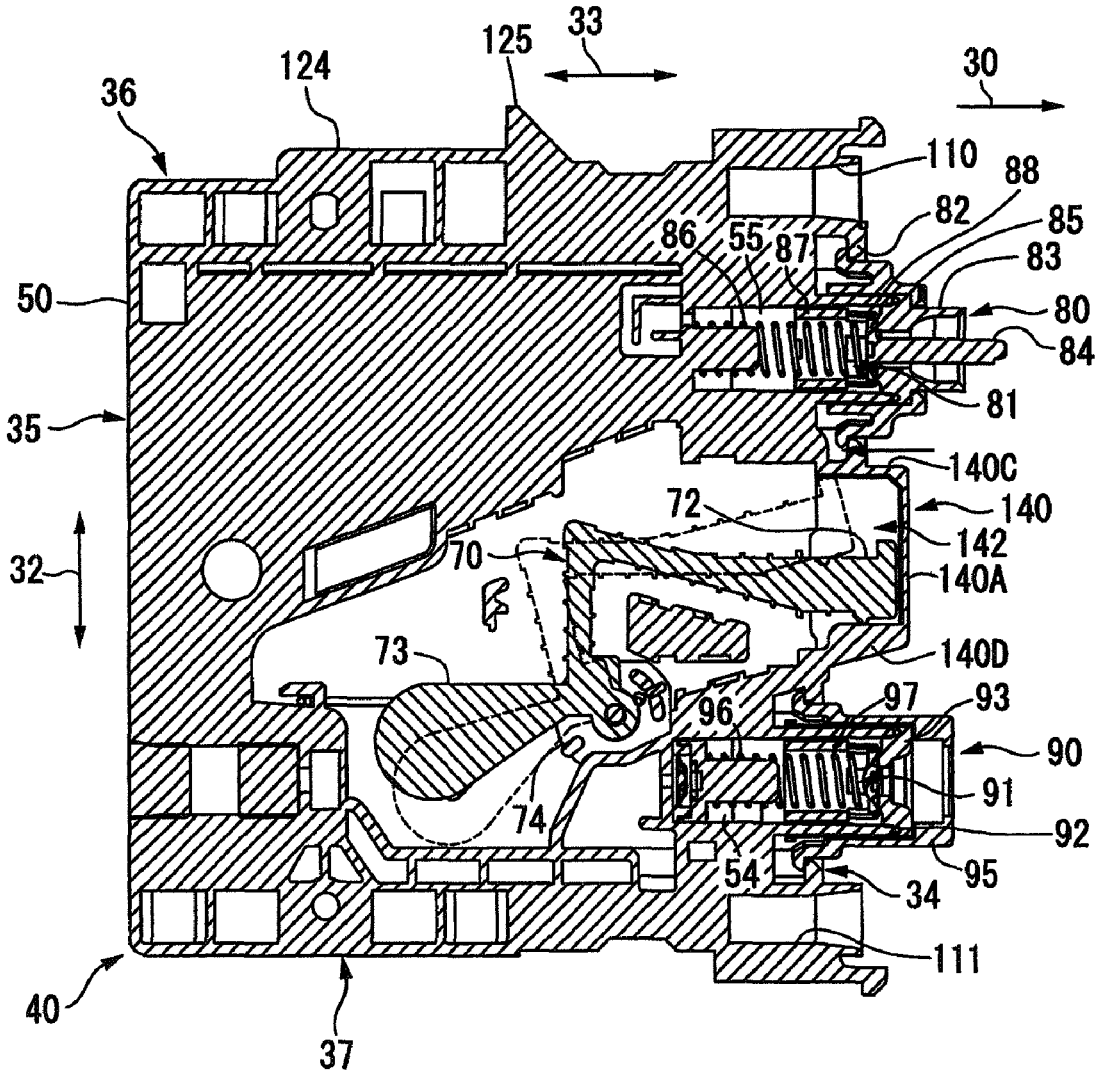
FIG. 5 is a cross-sectional view taken along the line V-V of FIG. 4.

Next, the ink cartridge 100A will be described with reference to FIGS. 2A to 5. FIGS. 2A and 2B are perspective views illustrating the external configuration of the ink cartridge 100A. Specifically, FIG. 2A is a perspective view illustrating a slider 41 disposed at a first position, and FIG. 2B is a perspective view illustrating the slider 41 disposed at a second position. FIGS. 3A and 3B are side views illustrating the ink cartridge 100A. Specifically, FIG. 3A is a side view illustrating the slider 41 disposed at the first position, and FIG. 3B is a side view illustrating the slider 41 disposed at the second position. FIGS. 4A and 4B are perspective views illustrating the configuration of a body 40. Specifically, FIG. 4A is a perspective view illustrating the body 40, as viewed from a front surface 34, and FIG. 4B is a perspective view illustrating the body 40, as viewed from a rear surface 35. FIG. 5 is a cross-sectional view taken along the line V-V of FIG. 4. The configuration of the ink cartridge 100B is similar to that of the ink cartridge 100A except for the shape of a detected portion 185 of the slider 41. The difference between the ink cartridge 100B and the ink cartridge 100A will be described in detail later.

As shown in FIGS. 2A to 3B, the ink cartridge 100A has a substantially hexahedral shape. Specifically, the ink cartridge 100A has a substantially rectangular parallelepiped shape that has a small width (in the direction of an arrow 31) and a height (in the direction of an arrow 32) and a depth (in the direction of an arrow 33) that are larger than the width. The ink cartridge 100A is inserted into the base unit 200 (see FIG. 7) in the direction of an arrow 30 (hereinafter, referred to as an 'insertion direction 30') in an erected state shown in FIGS. 2A to 3B, that is, with the bottom thereof facing downward and the top thereof facing upward in the drawings.

The ink cartridge 100A includes the body 40 (see FIG. 4) having ink stored therein, the slider 41, and a body cover 42. The external configuration of the ink cartridge 100A includes the slider 41 and the body cover 42. The body 40 is covered with the slider 41 and the body cover 42. In this exemplary embodiment, the body 40, the slider 41, and the body cover 42 are made of a resin material. Examples of the resin material include nylon, polyethylene, and polypropylene.

The body cover 42 covers substantially the entire body 40 (see FIGS. 4A, 4B). Specifically, the body cover 42 covers most of the body 40 except for a portion of the upper surface 36 (see FIGS. 4A, 4B) of the body 40 and the front surface 34 (see FIGS. 4A, 4B) of the body 40. In this way, most of the body 40, particularly, side surfaces 38 and 39 (see FIGS. 4A, 4B) of the body 40 are protected from an external impact. Since the configuration of the body cover 42 is not related to the present invention, a detailed description thereof will be omitted.

The slider 41 is attached to the body 40 through a coil spring (not shown). With the body cover 42 coupled to the body 40 (see FIG. 4), the slider 41 covers a front portion 46 of the body in the insertion direction 30 of the body cover 42 and the front surface 34 (see FIG. 4) of the body 40. The slider 41 is configured so as to slide in the depth direction (in the direction of an arrow 33) of the ink cartridge 100A. FIGS. 2A and 3A show the slider 41 disposed at the first position that is most distant from the front surface 34 (see FIG. 4) of the body 40 in the insertion direction 30, and FIGS. 2B and 3B show the slider 41 disposed at the second position that is closest to the front surface 34 of the body 40. The configuration of the slider 41 will be described below. However, since a mechanism that allows the slider 41 to slide is not related to the present invention, a detailed description thereof will be omitted in this exemplary embodiment.

[Body 40]

Next, the body 40 of the ink cartridge 100A will be described. As shown in FIGS. 4A and 4B, the body 40 has substantially the same shape as the ink cartridge 100A. That is, the body 40 has a substantially hexahedral shape. In this exemplary embodiment, as shown in FIGS. 4A and 4B, a surface of the body 40 that is on the front side in the insertion direction 30 is referred to as the front surface 34, a surface of the body that is on the rear side in the insertion direction 30 is referred to as the rear surface 35, a surface of the body that is on the upper side in the vertical direction is referred to as an upper surface 36, and a surface of the body that is on the lower side in the vertical direction is referred to as a lower surface 37. In addition, two surfaces that are adjacent to the front surface 34, the rear surface 35, the upper surface 36, and the lower surface 37 and face each other are referred to as the side surfaces 38 and 39. As viewed from the rear surface 35, the left side is the left surface 38, and the right side is the right surface 39. A pair of the side surfaces 38 and 39 has the largest area in the body 40. In this exemplary embodiment, the surfaces 34 to 39 do not indicate specific surface, but are defined as all the surfaces of the body 40, as viewed from the front side of the body 40.

The body 40 includes a frame 50, an arm 70, an air communicating valve 80, an ink supply valve 90, and a thin transparent film (not shown) adhered to the frame 50. In FIGS. 4A and 4B, the film is not shown.

The frame 50 is a member forming the casing of the body 40. The frame 50 forms the six surfaces 34 to 39 of the body 40. Therefore, the six surfaces 34 to 39 of the body 40 are the same as the six surfaces of the frame 50. In the following description, reference numerals given to the six surfaces of the body 40 denote the six surfaces of the frame 50.

The frame 50 is formed of a translucent member, for example, a transparent or translucent resin material. The frame 50 is formed of a resin material by injection molding. Examples of the resin material include polyacetal, nylon, polyethylene, and polypropylene.

As shown in FIGS. 4A and 4B, the frame 50 includes an outer wall 51 and a plurality of inner walls 52. The inner walls 52 are arranged inside the outer wall 51. The outer wall 51 and the inner walls 52 are integrally formed with the frame 50. The outer wall 51 and the inner walls 52 are provided between the left surface 38 and the right surface 39 of the body 40. The outer wall 51 is provided in a substantially annular shape along the front surface 34, the upper surface 36, the rear surface 35, and the lower surface 37 such that a space is defined in the outer wall. In this way, an opening 57 is formed in the left surface 38 of the frame 50, and an opening 58 is formed in the right surface 39.

The film is adhered to the edges of the two side surfaces 38 and 39 (the left and right surfaces of FIGS. 4A, 4B) of the frame 50, that is, the edge of the outer wall 51 facing the side surfaces 38 and 39 by a known thermal adhesion method. The film covers the openings 57 and 58. In this way, a space surrounded by the outer wall 51 and the film is partitioned as an ink chamber 102. Ink is stored in the partitioned ink chamber 102. In this exemplary embodiment, the ink chamber 102 is formed by the frame 50 and the film, but the present invention is not limited thereto. For example, the frame 50 may be formed in a rectangular parallelepiped shape, and the ink chamber 102 may be formed with the frame.

The inner walls 52 are provided in the space surrounded by the outer wall 51. The film is also adhered to the edges of the inner walls 52 facing the side surfaces 38 and 39. In this way, it is possible to prevent the film from being detached. In addition, even when the slider 41 and the body cover 42 are deformed toward the body 40, the inner walls 52 prevent the deformation of the slider 41 and the body cover 42.

As shown in FIGS. 4A and 4B, an ink injection portion 148 is formed in the rear surface 35 of the frame 50. The ink injection portion 148 is a hole that has a substantially cylindrical shape and is formed from the rear surface 35 to the ink chamber 102. The ink injection portion 148 communicates with the ink chamber 102. The ink injection portion 148 is for injecting ink into the ink chamber 102, and ink flows into the ink chamber 102 through the ink injection portion 148. The ink injection portion 148 is formed integrally with the frame 50 in the vicinity of the lower end of the rear surface 35. After ink is injected into the ink chamber 102, the ink injection portion 148 is closed by a rubber stopper.

A detecting portion 140 is formed on the front surface 34 of the frame 50. The detecting portion 140 is for visually or optically detecting the amount of ink stored in the ink chamber 102. The detecting portion 140 is formed integrally with the frame 50. Therefore, the detecting portion 140 is formed of the same material as that forming the frame 50. That is, the detecting portion 140 is made of a transparent or translucent resin material capable of transmitting light. The detecting portion 140 can transmit light incident from the outside.

The detecting portion 140 has a substantially rectangular parallelepiped shape. The detecting portion 140 protrudes from a middle portion of the front surface 34 of the body 40 to the outside of the body 40. The detecting portion 140 is partitioned by five wall surfaces having substantially rectangular shapes, and the inside of the detecting portion is formed in a hollow box shape. Specifically, the detecting portion 140 includes a rectangular front wall 140A that is parallel to the front surface 34 and is spaced from the front surface 34 to the outside by a specific distance, a pair of side walls 140B including two sides of the front wall 140A in the width direction, an upper wall 140C including the upper side of the front wall 140A, and a lower wall 140D including the lower side of the front wall 140A. The width of the front wall 140A (the dimension of the front wall in the direction of the arrow 31 in FIG. 4) is smaller than that of the front surface 34.

As shown in FIG. 5, a space 142 surrounded by the front wall 140A, the side walls 140B, the upper wall 140C, and the lower wall 140D is formed in the detecting portion 140. There is no wall on the side of the detecting portion 140 facing the ink chamber 102 such that the space 142 communicates with the ink chamber 102.

When the ink cartridge 100A is inserted into the base unit 200 (see FIG. 7), the detecting portion 140 enters an optical path 183 (see FIG. 9) of an optical sensor 181 (see FIG. 7) of the ink cartridge inserted into the base unit 200. A radiation region 144 (a region represented by a dotted line in FIGS. 4A, 4B) is formed below the detecting portion 140. The detecting portion 140 is inserted such that the radiation region 144 and the optical path 183 intersect each other. Light emitted from the optical sensor 181 is incident on the radiation region 144. The optical sensor 181 includes a light-emitting element and a light-receiving element. In this exemplary embodiment, light emitted from the light-emitting element is incident on the radiation region 144.

The arm 70 is provided in the body 40, that is, the ink chamber 102. The arm 70 is a member that detects the level of ink stored in the ink chamber 102. The arm 70 is made of a light-shielding resin material. The arm 70 is tiltably supported by a rib 74 that is vertically provided at the center of the outer wall 51 in the width direction (in the direction of the arrow 31). A floating portion 73 that serves as a floating member is provided at one end of the arm 70. The floating portion 73 is vertically moved depending on the amount of ink in the ink chamber 102. An indicator 72 arranged in the detecting portion 140 is provided at the other end of the arm 70.

When the floating portion 73 is vertically moved depending on the amount of ink in the ink chamber 102, the arm 70 is tilted to move the indicator 72 in the vertical direction in the space 142. Specifically, when the floating portion 73 is moved up, the indicator 72 is moved down in the space 142. When the indicator 72 reaches the lower wall 140D of the detecting portion 140, the indicator 72 is disposed at a first position that contacts the lower wall 140D (a position represented by a solid line in FIG. 5). In this case, the indicator 72 is positioned inside the radiation region 144 (a portion represented by a dashed line in FIG. 4) of the detecting portion 140. In this way, light passing through the radiation region 144 is shielded by the indicator 72.

On the other hand, when the amount of ink is less than a threshold value and the floating portion 73 is moved down, the indicator 72 is moved up in the space 142. When the indicator 72 reaches the upper wall 140C of the detecting portion 140, the indicator 72 is disposed at a second position (a position represented by a dashed line in FIG. 5) that contacts the upper wall 140C. In this case, the indicator 72 is positioned out of the radiation region 144. At the second position, light emitted from the optical sensor 181 to the radiation region 144 passes through the detecting portion 140 without being shielded by the indicator 72. It is possible to detect the level of ink in the ink chamber 102 by monitoring a variation in the state of the indicator 72 in the space 142 on the basis of the level of the signal output from the optical sensor 181.

As shown in FIG. 5, the air communicating valve 80 is provided at an upper part of the front surface 34 of the frame 50, that is, at an upper part of the detecting portion 140. The air communicating valve 80 is a valve that closes or opens an air passage 55 from the opening 82 formed in the front surface 34 to the ink chamber 102. For example, the air communicating valve 80 includes a valve body 87 that is slidably supported in the air passage 55, a spring 86 that urges the valve body 87, a seal member 83 that is provided at the edge of the opening 82, a rod 84 that is connected to the valve body 87, and a cap 85 that fixes the seal member 83. The cap 85 and the seal member 83 are provided with through holes (not shown). The through holes form an air communicating hole 81 through which the air passage 55 communicates with the outside. The rod 84 is inserted into the air communicating hole 81 to be exposed to the outside. When the rod 84 is pressed, the air communicating hole 81 is opened, and the internal pressure of the ink chamber 102 is equal to the atmospheric pressure. The air communicating valve 80 has a known configuration, and a detailed description thereof will be omitted in this exemplary embodiment.

An ink supply valve 90 is provided at a lower part of the front surface 34 of the frame 50, that is, below the detecting portion 140. The ink supply valve 90 is a valve that closes or opens an ink passage 54 extending from the opening 92 formed in the front surface 34 to the ink chamber 102. For example, the ink supply valve 90 includes a valve body 97 that is slidably supported in the ink passage 54, a spring 96 that urges the valve body 97, a seal member 93 that is provided at the edge of the opening 92, and a cap 95 that fixes the seal member 93. The cap 95 and the seal member 93 are provided with through holes (not shown). The through holes form an ink supply port 91 through which the ink passage 54 communicates with the outside. When a tubular ink needle 209 (see FIG. 7) is inserted into the ink supply port 91, the ink passage 54 and an inner hole of the ink needle 209 communicate with each other. In this way, it is possible to supply ink to the printer unit 12. The ink supply value 90 has a known configuration, and a detailed description thereof will be omitted in this exemplary embodiment.

As shown in FIG. 5, a spring accommodating chamber 110 is formed above the air passage 55. In addition, a spring accommodating chamber 111 is formed below the ink passage 54. The spring accommodating chambers 110 and 111 are substantially cylindrical holes formed from the front surface 34 of the frame 50 to the ink chamber 102. Coil springs (not shown) that elastically urge the slider 41 in the insertion direction 30 are accommodated in the spring accommodating chambers 110 and 111. The positions, the outside diameters, or the depths of the spring accommodating chambers 110 and 111 depend on the specifications of the springs.

As shown in FIGS. 4A, 4B and 5, a table portion 124 is provided on the upper surface 36 of the frame 50. The table portion 124 extends from a middle portion of the upper surface 36 in the depth direction (in the direction of the arrow 33) backward in the insertion direction 30. The table portion 124 is exposed to the outside through the opening 128 (see FIG. 2) formed in the upper surface of the body cover 42 with the body 40 being covered with the body cover 42. The rear end of the table portion 124 does not reach the rear surface 35.

A stopper 125 that protrudes from the table portion 124 upward is provided in the table portion 124. The stopper 125 is provided at the leading end of the table portion 124 in the insertion direction 30. The stopper 125 includes a vertical wall 126 that is vertical with respect to the table portion 124 and an inclined rib 127 that is inclined from the top of the vertical wall 126 downward to the front side of the upper surface 36 in the insertion direction 30 at an angle of about 45°. When the ink cartridge 100A is inserted into the base unit 200, the stopper 125 is used to fix the ink cartridge 100A such that the ink cartridge 100A is not detached from the base unit 200. The ink cartridge 100A is fixed by engagement between the stopper 125 and a lock lever 230 (see FIG. 7), which will be described below.

[Slider 41]

Next, the configuration of the slider 41 will be described.

As shown in FIGS. 2A to 3B, the slider 41 is formed in the shape of a container capable of accommodating a front portion 46 of the body cover 42 and the front surface 34 (see FIGS. 4A, 4B) of the body 40, with the body cover 42 being coupled to the body 40. The slider 41 is flat so as to correspond to the outward appearance of the front portion 46 and the front surface 34. Specifically, the slider 41 includes a front wall 161 corresponding to the front surface 34, an upper wall 163 corresponding to the upper surface of the front portion 46, a lower wall 164 corresponding to the lower surface of the front portion 46, and left and right side walls 165 and 166 corresponding to both side surfaces of the front portion 46. The front portion 46 and the front surface 34 are accommodated in a space surrounded by the walls.

The left side wall 165 and the right side wall 166 extend from the front wall 161 in the depth direction (in the direction of the arrow 33) of the body 40, and cover the left surface 38 and the right surface 39 of the body 40 from the upper side of the front portion 46, respectively. Therefore, when the slider 41 slides relative to the body 40, the two side surfaces of the front portion 46 serve as guide surfaces that guide the movement of the slider 41 in the sliding direction, which will be described below. In this way, the slider 41 can smoothly slide.

The slider 41 includes a detected portion 185 for detecting the kind of ink cartridge 100, a detected portion 186 for detecting whether the ink cartridge 100 is inserted, a cutout 187, an opening 177, and an opening 178.

As shown in FIGS. 2A to 3B, the cutout 187 is formed in the middle of the front wall 161. The cutout 187 serves as a window through which the detecting portion 140 is exposed when the slider 41 is mounted to the body 40. Therefore, the cutout 187 is formed so as to correspond to the positions, dimensions, and shapes of the front wall 140A and the side wall 140B of the detecting portion 140. Specifically, the cutout 187 is formed by cutting out the side walls 165 and 166 from the front wall 161 to the rear side in the insertion direction 30 in a rectangular shape. When the ink cartridge 100A is inserted into the base unit 200, the light-emitting element and the light-receiving element of the optical sensor 181 (see FIG. 7), which will be described below, are arranged so as to face the cutout 187. Therefore, with the ink cartridge 100A being inserted into the base unit, light emitted from the light-emitting element is incident on the side wall 140B of the detecting portion 140 through the cutout 187.

The detected portion 185 enters an optical path 183 (see FIG. 9) of the optical sensor 181, which will be described below, provided in the base unit 200, when the ink cartridge 100A is inserted into the base unit 200. The detected portion 185 is formed of a resin material that does not transmit light. The detected portion 185 is provided in the vicinity of a middle portion of the front wall 161.

The detected portion 185 includes a bridge portion 189 that protrudes from the front wall 161 in the insertion direction 30. The bridge portion 189 is provided so as to be laid across the cutout 187 in the vertical direction on the front wall 161. The bridge portion 189 includes a side wall 191. The side wall 191 extends from the end of the side surface of the bridge portion 189 (in the direction of the arrow 31) so as to substantially reach the front wall 161. The bridge portion 189 and the cutout 187 form an opening 190 that has a rectangular shape in a side view.

The detected portion 186 enters an optical path 184 (see FIG. 9) of an optical sensor 182, which will be described below, provided in the base unit 200, when the ink cartridge 100A is inserted into the base unit 200. The detected portion 186 is formed of a resin material that does not transmit light, similar to the detected portion 185. The detected portion 186 is vertically formed on the bottom of a concave portion 194 that is formed at the leading end of the upper wall 163 in the insertion direction 30. The detected portion 186 is a flat rib that protrudes from the bottom of the concave portion 194 upward. When the ink cartridge 100A is inserted into the base unit, the detected portion 186 enters the optical path 184 of the optical sensor 182.

As shown in FIGS. 2A and 2B, an opening 177 is formed at an upper part of the front wall 161. The opening 177 is formed at a position corresponding to the air communicating valve 80. The opening 177 has a sufficient size for a pressing portion 216 (see FIG. 9) provided in the base unit 200 to pass through. When the ink cartridge 100A is inserted into the base unit 200, the pressing portion 216 passes through the opening 177.

An opening 178 is formed at a lower part of the front wall 161. The opening 178 is formed at a position corresponding to the ink supply valve 90. The opening 178 has a sufficient size for the cap 95 of the ink supply valve 90 to pass through. When the slider 41 slides from the first position shown in FIG. 2A to the second position shown in FIG. 2B, the cap 95 is exposed to the outside through the opening 178 during the sliding operation. In this way, it is easy for the ink needle 209 (see FIG. 7) of the base unit 200 to be inserted into the ink supply port 91. When the slider 41 slides from the second position to the first position, the cap 95 is inserted into the slider 41.

[Configuration of Ink Cartridge 100B]

Figure 6B:
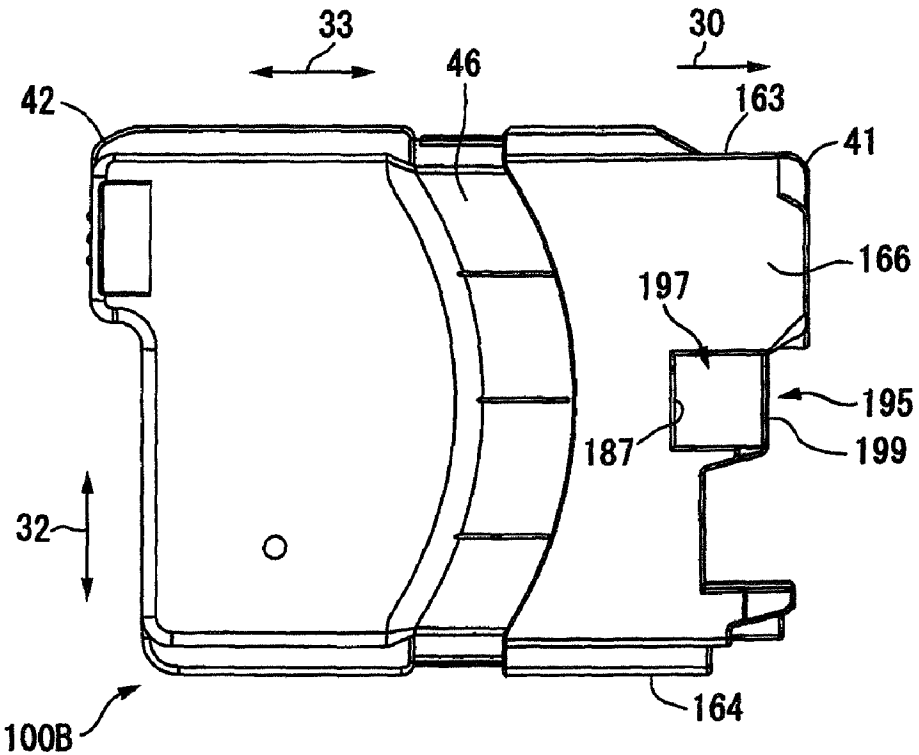
FIGS. 6A and 6B are diagrams illustrating the external configuration of an ink cartridge according to an exemplary embodiment.
Figure 6A:
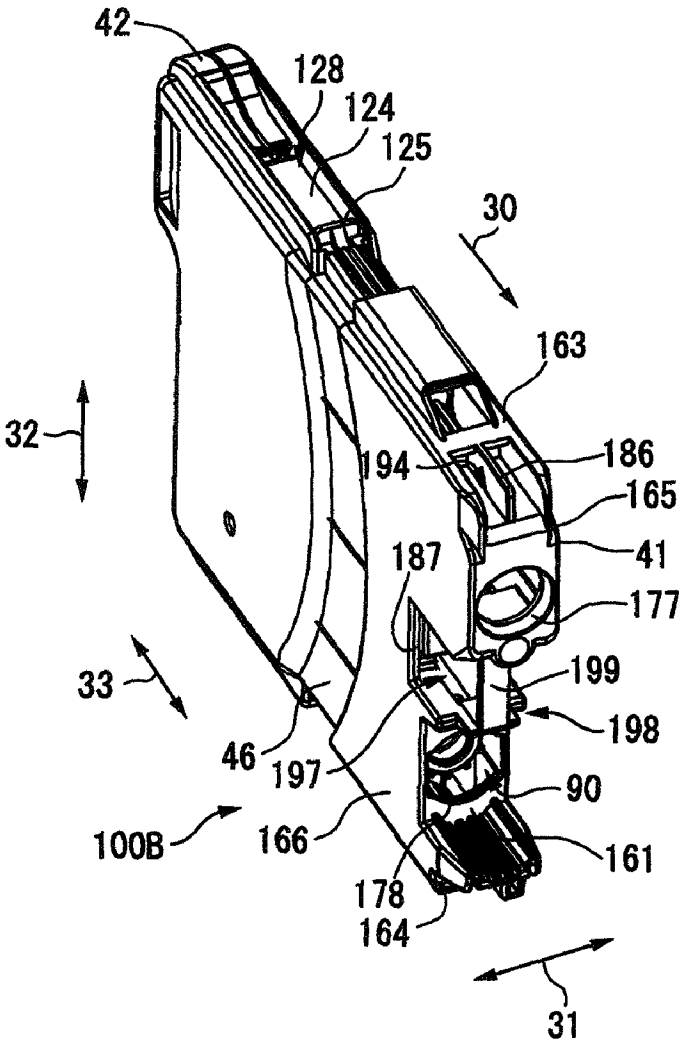

Next, the configuration of the ink cartridge 100B will be described. The configuration of the ink cartridge 100B is similar to that of the ink cartridge 100A except that a detected portion 198 has a configuration different from that of the detected portion 185 of the ink cartridge 100A. The detected portion 198 will be described below with reference to FIGS. 6A and 6B. In the following description, the same components as described above are denoted by the same reference numerals, and a description thereof will be omitted. FIGS. 6A and 6B are diagrams, illustrating the external configuration of the ink cartridge 100B. Specifically, FIG. 6A is a perspective view illustrating the ink cartridge 100B, and FIG. 6B is a side view illustrating the ink cartridge 100B.

As shown in FIG. 6, the detected portion 198 is provided in the slider 41 of the ink cartridge 100B. The detected portion 198 enters the optical path 183 (see FIG. 9) of the optical sensor 181, which will be described below, provided in the base unit 200, when the ink cartridge 100B is inserted into the base unit 200. The detected portion 198 is formed of a resin material that does not transmit light, similar to the detected portion 185. The detected portion 198 is provided in the vicinity of a middle portion of the front wall 161.

The detected portion 198 includes a bridge portion 199 that protrudes from the front wall 161 in the insertion direction 30. The bridge portion 199 is provided so as to be laid across the cutout 187 in the vertical direction on the front wall 161. The bridge portion 199 and the cutout 187 form an opening 197 that has a rectangular shape in a side view. The bridge portion 199 is a thin flat plate member, unlike the bridge portion 189 of the detected portion 185. Therefore, the width (length in the direction of the arrow 33) of the opening 197 is larger than that of the opening 190.

[Base Unit]

Figure 7:
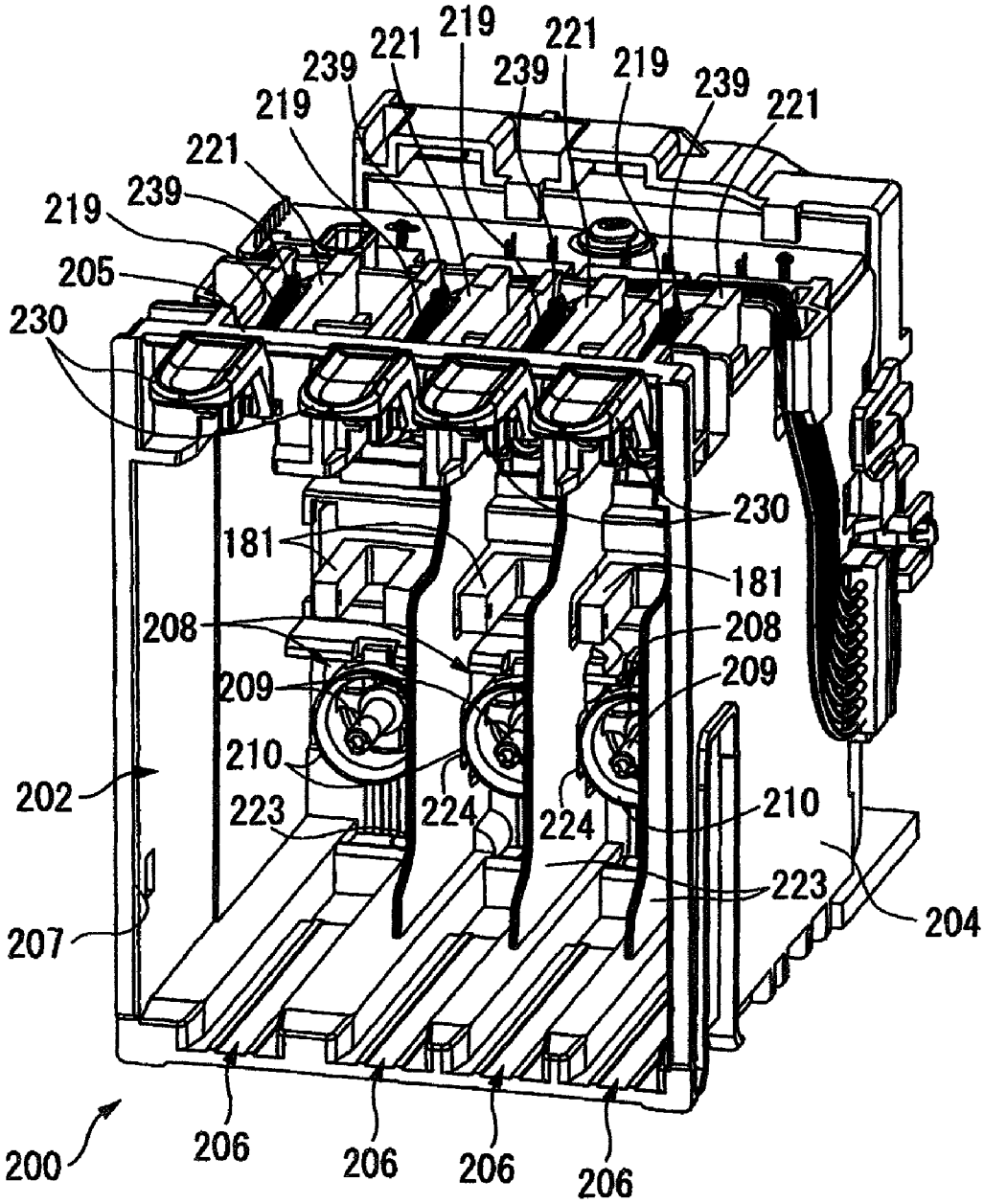
FIG. 7 is a perspective view illustrating the configuration of a base unit according to an exemplary embodiment.
Figure 8:
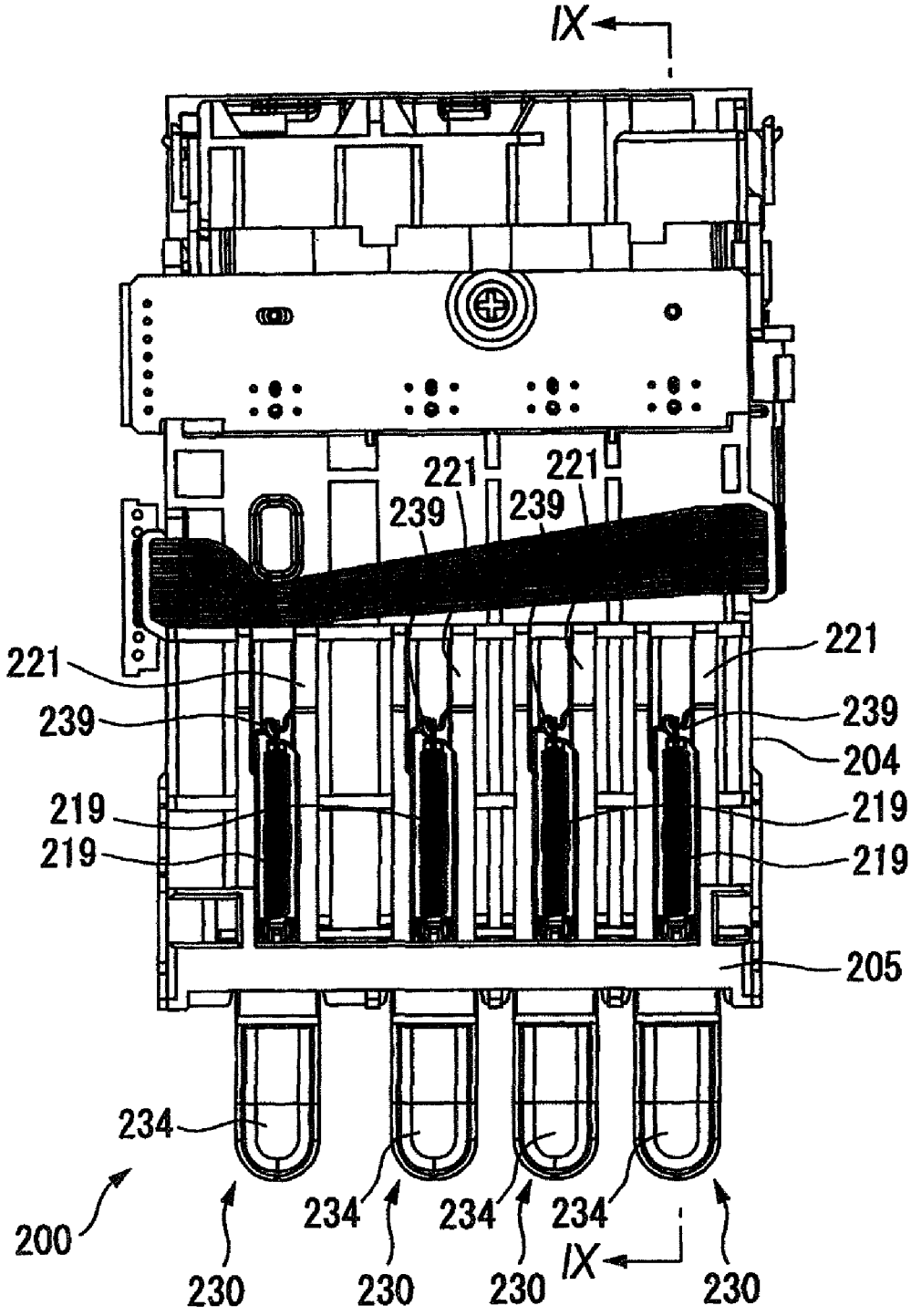
FIG. 8 is a plan view illustrating the base unit.
Figure 9:
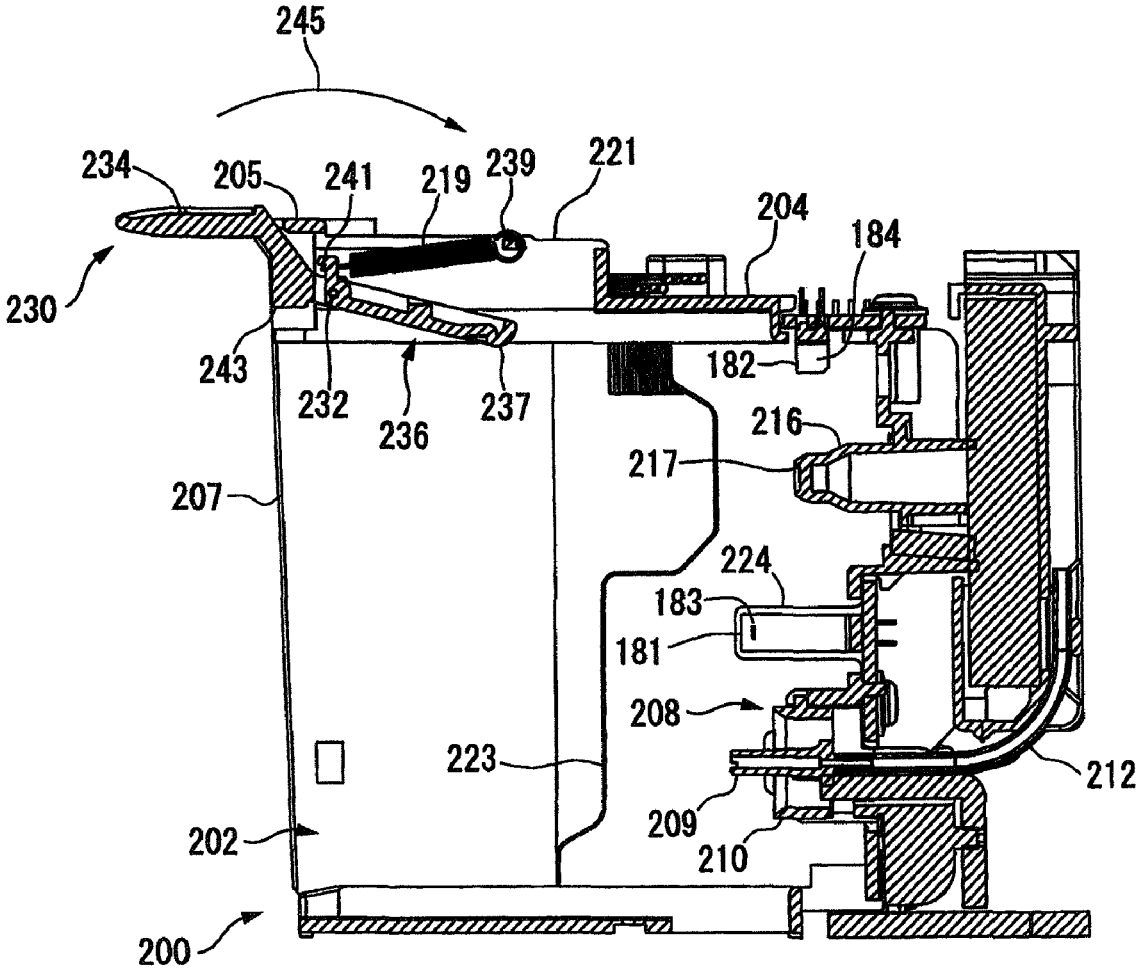
FIG. 9 is a cross-sectional view taken along the line IX-IX of FIG. 8.

Next, the configuration of the base unit 200 will be described with reference to FIGS. 7 to 9. FIG. 7 is a perspective view illustrating the configuration of the base unit 200. FIG. 8 is a plan view illustrating the base unit 200. FIG. 9 is a cross-sectional view taken along the line IX-IX of FIG. 8.

As shown in FIG. 7, the base unit 200 includes a frame 204 that is formed in the shape of a container having an opening 207 formed in the front surface. The inter space of the frame 204 is the cartridge mounting portion 202 for accommodating the ink cartridge 100. The cartridge mounting portion 202 is capable of accommodating four ink cartridges 100 corresponding to cyan, magenta, yellow, and black.

As shown in FIGS. 7 and 9, three plates 223 that partition the inner space into four longitudinal spaces are provided in the cartridge mounting portion 202. The ink cartridges 100 are accommodated in the spaces partitioned by the plates 223. The plates 223 are formed on the inner rear surface of the cartridge mounting portion 202. The plates 223 are vertically provided on the inner rear surface of the frame so as to protrude toward the opening 207. The plates 223 are arranged in the width direction of the base unit 200. Each of the plates 223 has a rectangular cutout 224. The cutout 224 is formed so as to have a size corresponding to the shape of the optical sensor 181, which will be described below. Specifically, as shown in FIG. 9, the size of the cutout is larger than that of the optical sensor 181 in a side view. Therefore, the optical sensor 181 does not contact the plate 223.

Four guide grooves 206 are formed in the bottom of the frame 204. The guide grooves 206 are for smoothly guiding the ink cartridge 100 to the inner rear surface of the cartridge mounting portion 202. The guide grooves 206 extend straight in the depth direction of the base unit 200. The guide grooves 206 are arranged at predetermined intervals in the width direction of the base unit 200. The leftmost guide groove 206 has a width that is larger than those of the other guide grooves 206, in order to enable the black ink cartridge having a width that is larger than those of the other ink cartridges to be inserted. The lower ends of the ink cartridges 100 are guided along the guide grooves 206 in the depth direction and the ink cartridges 100 are smoothly inserted into the cartridge mounting portion 202.

Connecting portions 208 connected to the ink supply ports 91 are provided at a lower part of the inner rear surface of the cartridge mounting portion 202. The connecting portions 208 are arranged on the inner rear surface at positions corresponding to the ink supply valves 90 of the ink cartridges 100. In this exemplary embodiment, four connecting portions 208 corresponding to four ink cartridges 100 capable of being inserted into the cartridge mounting portion 202 are provided. In FIG. 7, the rightmost connecting portion 208 is concealed by the side wall of the frame 204.

Each of the connecting portions 208 includes an ink needle 209 and a holding portion 210. The ink needle 209 is a tubular resin needle. As shown in FIG. 9, the ink needle 209 is connected to a flexible ink tube 212 on the rear surface of the base unit 200. The ink tube 212 extending from the ink needle 209 to the rear surface is bent upward along the rear surface of the base unit 200, and reaches a recording head (not shown) of the printer unit 12.

The holding portion 210 is formed in a concave shape. The ink needle 209 is provided at the center of the holding portion 210. When the ink cartridge 100 is inserted into the cartridge mounting portion 202, the cap 95 (see FIG. 2B) is inserted into the concave portion of the holding portion 210. In this case, the circumferential surface of the cap 95 is closely attached to the inner surface of the concave portion of the holding portion 210. In this way, the cap 95 and the holding portion 210 are tightly connected to each other.

Pressing portions 216 (see FIG. 9) each pressing the rod 84 of the air communicating valve 80 are provided at an upper part of the inner rear surface of the cartridge mounting portion 202. The pressing portions 216 are arranged on the inner rear surface at positions corresponding to the air communicating valves 80. In this exemplary embodiment, four pressing portions 216 corresponding to four ink cartridges 100 capable of being inserted into the cartridge mounting portion 202 are provided. As shown in FIG. 9, the pressing portion 216 protrudes from the inner rear surface in the vertical direction. A concave portion 217 is formed at the end of the protruding portion of the pressing portion 216. When the ink cartridge 100 is inserted into the cartridge mounting portion 202, the pressing portion 216 passes through the opening 177 and contacts the leading end of the rod 84. In this case, the rod 84 is reliably fixed by the concave portion 217. When the pressing force of the rod 216 is applied to the rod 84, the rod 84 is moved backward, and the air communicating hole 81 is opened.

The optical sensors 181 are provided above the connecting portions 209 on the inner rear surface of the cartridge mounting portion 202. The optical sensors 181 are arranged at positions corresponding to the detecting portions 140 of the ink cartridges 100. In addition, the optical sensors 182 (see FIG. 9) are provided on the inner surface of the ceiling of the cartridge mounting portion 202. The optical sensors 182 are arranged at positions corresponding to the detected portions 186 of the ink cartridges 100. In this exemplary embodiment, four optical sensors 181 and four optical sensors 182 are provided to correspond to four ink cartridges 100 capable of being inserted into the cartridge mounting portion 202. In FIG. 7, the rightmost optical sensor 181 is concealed by the side wall of the frame 204.

Each of the optical sensors 181 detects the amount of ink in the ink chamber 102 of the ink cartridge 100. The optical sensor 181 and a main control unit 250 (see FIG. 12), which will be described below.

Each of the optical sensors 182 detects whether the ink cartridge 100 is inserted into the cartridge mounting portion 202. The optical sensor 182 also determines the kind of ink cartridge 100 inserted into the cartridge mounting portion 202. The optical sensor 182 and the main control unit 250 (see FIG. 12) will be described below. Transmission-type photo interrupter having a light-emitting element and a light-receiving element is used as each of the optical sensors 181 and 182 in this exemplary embodiment.

The optical sensors 181 and 182 are connected to the main control unit 250 (see FIG. 12), which will be described below. The optical path 183 through which light emitted from the light-emitting element travels is defined between the light-emitting element and the light-receiving element of the optical sensor 181. Similarly, the optical path 184 is formed in the optical sensor 182. In this exemplary embodiment, the main control unit 250 determines the kind of ink cartridge 100 on the basis of a signal (the amount of light received) output from the optical sensor 181 when the detected portion 185 is inserted into the optical path 183 and a signal (the amount of light received) output from the optical sensor 182 when the detected portion 186 is inserted into the optical path 184. In addition, the main control unit 250 determines whether the remaining amount of ink is equal to a threshold value, on the basis of a signal (the amount of light received) output from the optical sensor 181 when the detecting portion 140 is inserted into the optical path 183, and determines whether the ink cartridge 100 is inserted on the basis of a signal (the amount of light received) output from the optical sensor 182 when the detected portion 186 is inserted into the optical path 183.

The frame 204 is provided with the lock levers 230. Each of the lock levers 230 is for fixing (locking) the ink cartridge 100 such that the ink cartridge 100 is not detached from the cartridge mounting portion 202. As shown in FIGS. 7 to 9, the lock lever is provided in the vicinity of an upper edge 205 of the opening 207 of the frame 204. In this exemplary embodiment, four lock levers 230 are provided to correspond to four ink cartridges 100 capable of being inserted into the cartridge mounting portion 202. The lock levers 230 make it possible to hold the ink cartridges 100 inserted into the cartridge mounting portion 202 and reliably fix the ink cartridges 100 to the cartridge mounting portion 202.

As shown in FIG. 9, the lock lever 230 has an arm shape. A supporting shaft 232 is provided in the vicinity of the center of the lock lever 230. The supporting shaft 232 is supported by the frame 204. In this way, the lock levers 230 are supported by the frame 204 such that they can rotate on the supporting shafts 232 in the vicinity of the upper edge 205 of the frame 204.

Each of the lock levers 230 includes an input portion 234, an operating portion 236, and an engaging portion 243. The input portion 234 is provided in front of the supporting shaft 232, and the operating portion 236 is provided on the rear side of the supporting shaft 232 in the depth direction. The input portion 234 is formed in a dish shape having a shallow concave portion formed in the upper surface. Therefore, it is easy for the user to press the input portion 234 downward with the fingers.

The engaging portion 243 is provided at the lower end of a portion that extends from the supporting shaft 232 to the input portion 234. The engaging portion 243 is moved down to the cartridge mounting portion 202 when the input portion 234 is pressed downward, and contacts the upper surface of the ink cartridge 100A.

A contact portion 237 that contacts the stopper 125 of the ink cartridge 100 is provided at the leading end of the operating portion 236. A lower part of the contact portion 237 is curved. The operating portion 236 is formed substantially in a straight line from the supporting shaft 232 to the contact portion 237.

A spring 219 is provided above the lock lever 230. One end of the spring 219 on the rear side of the frame is fixed to the frame 204 above the contact portion 237. Specifically, a flat rib 221 is vertically provided on the upper surface of the frame 204, and one end of the spring 219 is hooked to a hooking portion 239 protruding from the rib 221 in the horizontal direction. The other end of the spring 219 is hooked to an L-shaped hooking portion 241 that protrudes from an upper part of the supporting shaft 232 upward. The hooking portion 241 is disposed at a position that is slightly lower than the hooking portion 239. The spring 219 is used as a so-called tension spring. That is, the spring 219 is extended to generate contractile force, and in this state, the spring 219 is fixed to the hooking portions 239 and 241. Therefore, the lock lever 230 receives from the spring 219 turning force in the direction of an arrow 245 in FIG. 9 (the clockwise direction in FIG. 9). The upper edge 205 of the opening 207 of the frame 204 regulates excessive rotation of the lock lever 230. Therefore, when no external force is applied to the input portion 234, the rotation of the lock lever 230 in the direction of the arrow 245 is regulated by the upper edge 205. In this state, the input portion 234 is maintained substantially in the horizontal direction. In this exemplary embodiment, the lock lever 230 is rotated in the direction of the arrow 245 in the range in which the contact portion 237 is moved down to the cartridge mounting portion 202 to contact the table portion 124 of the ink cartridge 100.

[Insertion of Ink Cartridge 100A]

Figure 10:
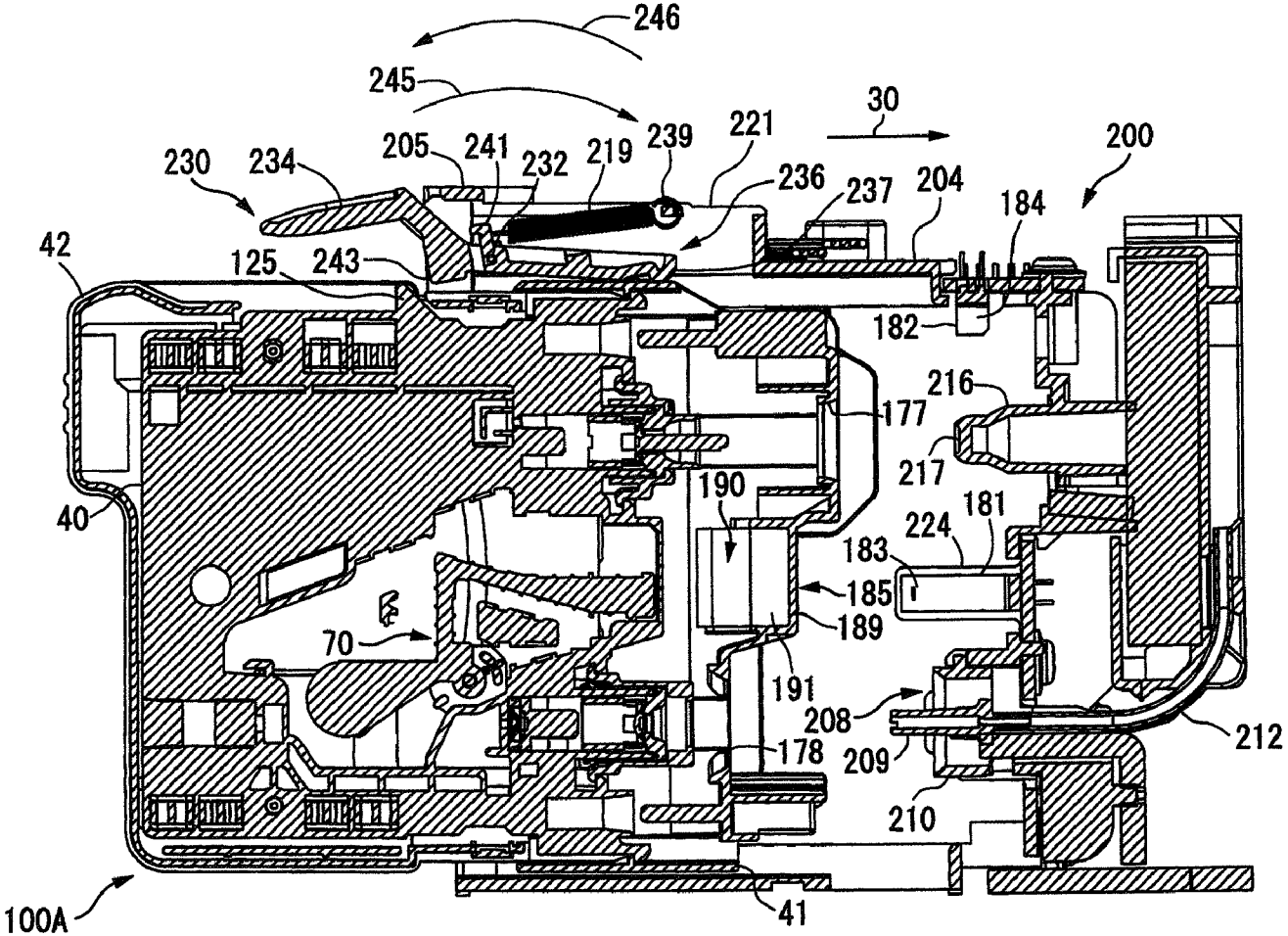
FIG. 10 is a cross-sectional view schematically illustrating the mounting of the ink cartridge shown in FIGS. 2A and 2B on the cartridge mounting portion, and shows the non-mounting state of the ink cartridge.
Figure 11:
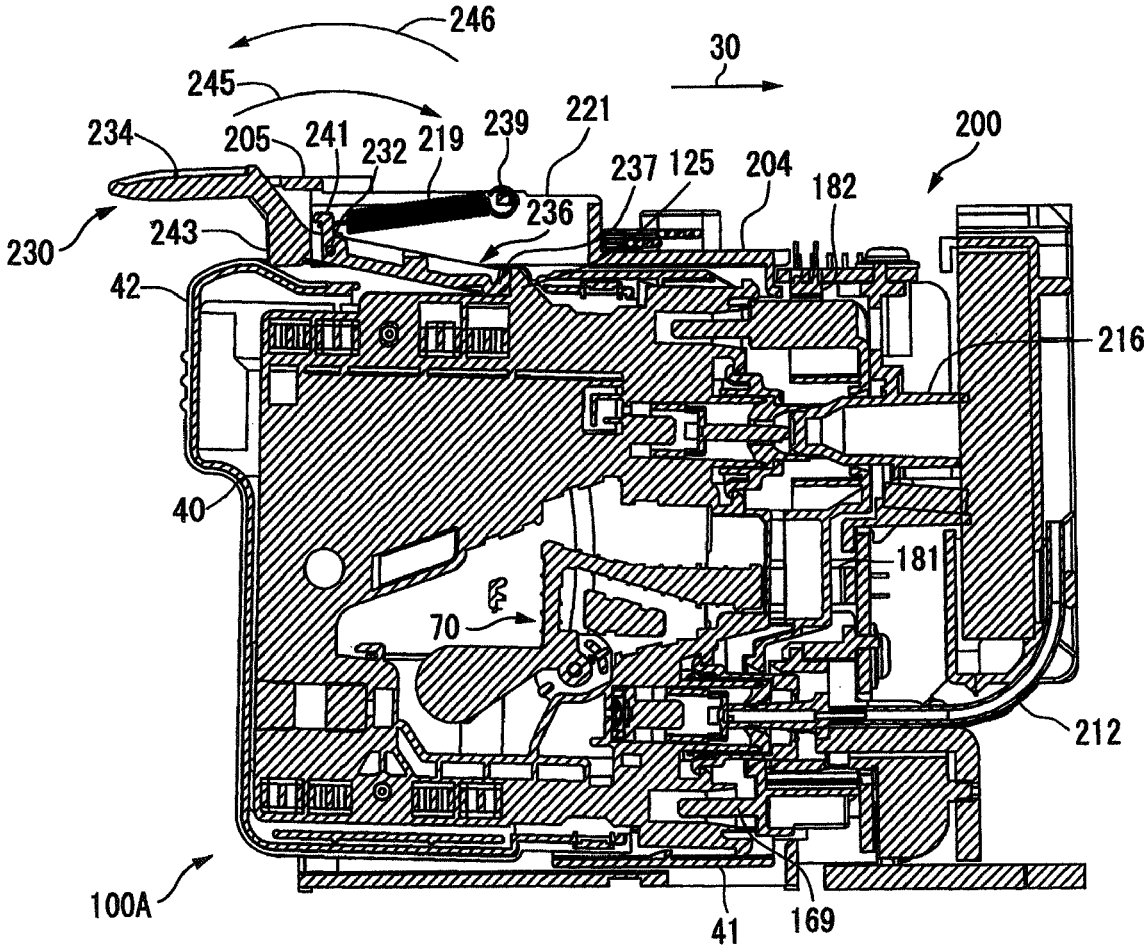
FIG. 11 is a cross-sectional view schematically illustrating the mounting of the ink cartridge shown in FIGS. 2A and 2B on the cartridge mounting portion, and shows the ink cartridge mounted and fixed to the cartridge mounting portion.

Next, the insertion (mounting) of the ink cartridge 100A into the base unit 200 will be described with reference to FIGS. 10 and 11. FIGS. 10 and 11 are cross-sectional views schematically illustrating the insertion of the ink cartridge 100A into the cartridge mounting portion 202. FIG. 10 shows the ink cartridge 100A and the base unit before insertion, and FIG. 11 shows the ink cartridge 100A inserted into the base unit.

As shown in FIG. 10, when the ink cartridge 100A is inserted into the cartridge mounting portion 202 through the opening 207 of the frame 204, the leading end of the ink cartridge 100A contacts the contact portion 237 of the lock lever 230. In this case, the contact portion 237 is pressed upward by the ink cartridge 100A. Then, the lock lever 230 is rotated in the direction of an arrow 246 against the tensile force of the spring 219. The rotating operation causes the input portion 234 to be slightly inclined downward. That is, the input portion 234 is deformed from a horizontal position to an inclined position.

When the ink cartridge 100A is moved in the depth direction of the cartridge mounting portion 202, first, the bridge portion 189 of the detected portion 185 of the slider 41 enters the optical path 183 of the optical sensor 181. Then, the detected portion 186 enters the optical path 184 of the optical sensor 182. At the time when the detected portion 186 enters the optical path 184, the detected portion 185 has already entered the optical path 183 of the optical sensor 181. In this case, on the optical path 183, light emitted from the light-emitting element is shielded by the side wall 191 of the detected portion 185.

When the ink cartridge 100A is further moved in the depth direction of the mounting portion 202, the front surface of the slider 41 contacts the inner rear surface of the cartridge mounting portion 202. In this case, the detected portion 185 is out of the optical path 183 of the optical sensor 181, and the opening 190 enters the optical path 183. The detected portion 186 is maintained on the optical path 184.

When the ink cartridge 100A is inserted into the cartridge mounting portion 202, the pressing portion 216 passes through the opening 177 of the slider 41.

When the ink cartridge 100A is pressed in the insertion direction 30 with the slider 41 coming into contact with the inner rear surface of the cartridge mounting portion 202, a coil spring (not shown) is compressed against its elastic force. In this way, only the body 40 is moved in the insertion direction 30, with the slider 41 coming into contact with the inner rear surface of the cartridge mounting portion. That is, the body 40 is moved so as to be close to the slider 41. In this way, the slider 41 is relatively moved from the first position (see FIG. 2A) to the second position (see FIG. 2B).

When the body 40 is moved to a position closet to the slider 41 (second position), that is, when the body 40 is inserted up to the inner rear surface of the cartridge mounting portion 202, as shown in FIG. 11, the rod 84 contacts the pressing portion 216. The rod 84 is pressed by the pressing force of the pressing portion 216. In addition, the cap 95 of the ink supply valve 90 is exposed through the opening 178, and the ink needle 209 is inserted into the ink supply port 91. The detecting portion 140 is inserted into the opening 190 and the optical path 183 of the optical sensor 181. In this state, the optical sensor 181 can monitor the amount of ink from the detecting portion 140.

When the ink cartridge 100A is inserted up to the inner rear surface of the cartridge mounting portion 202, the contact portion 237 provided at the leading end of the lock lever 230 is moved to the rear side of the ink cartridge 100A while coming into slide contact with a portion extending from the upper wall 163 to the inclined rib 127. Then, when the ink cartridge 100A is inserted up to the inner rear surface of the cartridge mounting portion 202, that is, when the ink cartridge 100A is completely inserted into the cartridge mounting portion 202, the contact portion 237 goes over the stopper 125. In this case, the operating portion 236 is rotated in the direction of the arrow 245 by the tensile force of the spring 219, and the contact portion 237 is moved to be placed on the upper surface of the table portion 124. In this way, the contact portion 237 contacts the stopper 125. Therefore, the movement of the body 40 backward by the coil springs 48 and 49 is regulated. As a result, as shown in FIG. 11, the ink cartridge 100A is fixed to the base unit 200. As shown in FIG. 11, the input portion 234 returns to a substantially horizontal position, with the contact portion 237 being placed on the upper surface of the table portion 124.

[Main Control Unit 250]

Figure 12:
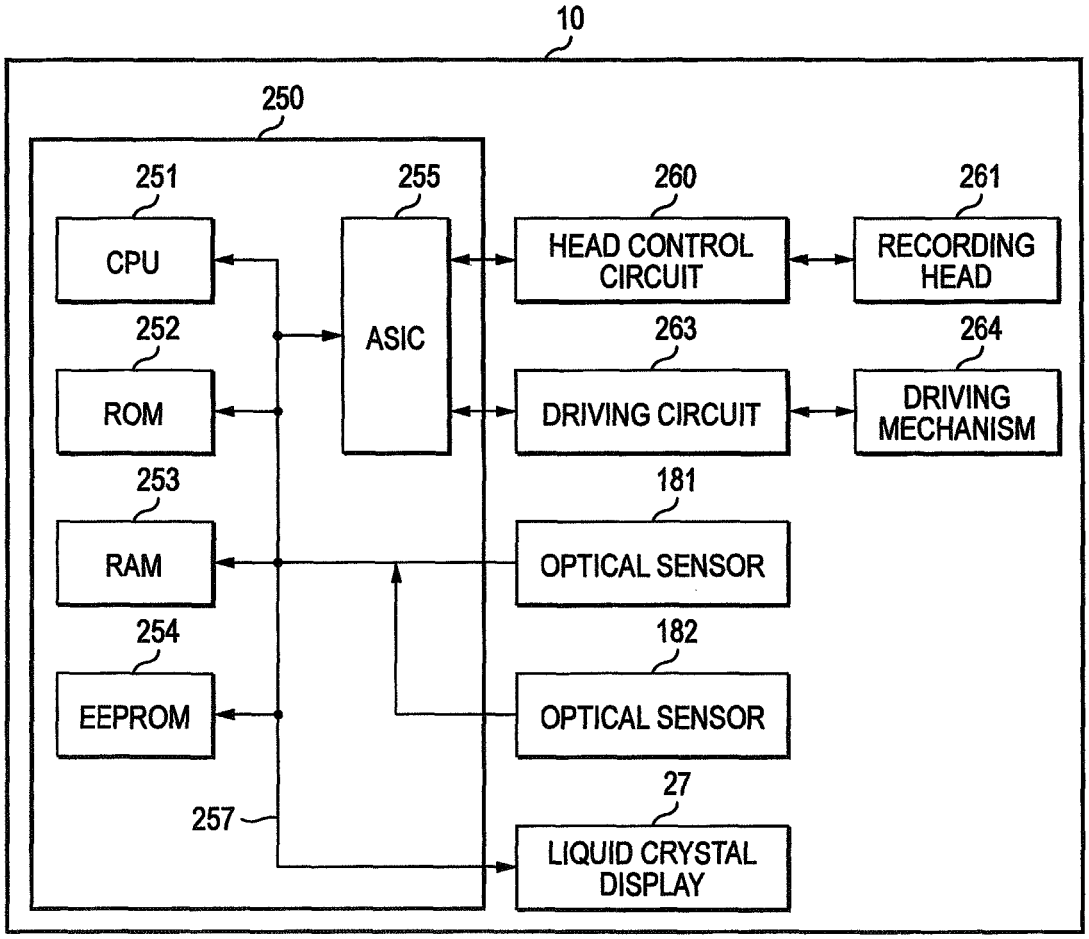
FIG. 12 is a block diagram schematically illustrating the configuration of a main control unit according to an exemplary embodiment.

Next, the schematic configuration of the main control unit 250 of the multi-function machine 10 will be described with reference to FIG. 12. FIG. 12 is a block diagram schematically illustrating the configuration of the main control unit 250.

The main control unit 250 controls the overall operation of the multi-function machine 10. As shown in FIG. 12, the main control unit 250 is composed of a microprocessor including as main components a central processing unit (CPU) 251, a read only memory (ROM) 252, a random access memory (RAM) 253, an electrically erasable and programmable memory (EEPROM) 254, and an application specific integrated circuit (ASIC) 255. In the main control unit 250, the components are connected to each other via a bus 257 such that they can communicate with each other.

The ROM 252 stores a program for allowing the CPU 251 to control various operations of the multi-function machine 10 or a program for allowing the liquid crystal display 27 to display error information or status information. The RAM 253 is used as a storage area or a work area that temporarily stores various data used when the CPU 251 executes the programs. The EEPROM 254 stores setup information and flags that are maintained even when power is turned off.

The ASIC 255 is connected to, for example, a head control circuit 260 of the printer unit 12 or a driving circuit 263 that drives a driving mechanism 264, such as a sheet feed device or a transport device. The head control circuit 260 controls the driving of a recording head 261 on the basis of signals (control signals and image signals) input from the ASIC 255. In this way, the recording head 261 can selectively discharge color inks from the nozzles at a predetermined timing. In addition, the driving circuit 263 operates the sheet feed device or the transport device at a predetermined timing.

The liquid crystal display 27 is connected to the main control unit 250. Information stored in the RAM 253 or the EEPROM 254, or information obtained by the operation of the CPU 251 is output to the liquid crystal display 27 through the bus 257. In this way, various information items are displayed on the liquid crystal display 27.

The optical sensor 181 is connected to the main control unit 250. The optical sensor 181 outputs a signal (hereinafter, referred to as a sensor signal) corresponding to the brightness of light (the amount of light) received by the light-receiving element. Specifically, the optical sensor 181 outputs an analog electric signal (a voltage signal or a current signal) corresponding to the brightness of light that is emitted from the light-emitting element of the optical sensor 181 and then received by the light-receiving element. The output sensor signal is input to the main control unit 250. When the electric level (a voltage value or a current value) of the sensor signal is higher than a threshold value, the main control unit 250 determines that the received sensor signal is a high-level signal. When the electric level is lower than the threshold value, the main control unit 250 determines that the received sensor signal is a low-level signal. In this exemplary embodiment, when light traveling through the optical path 183 of the optical sensor 181 is shielded, the sensor signal is determined as a low-level signal. On the other hand, when no light is shielded, the sensor signal is determined as a high-level signal.

The optical sensor 182 is connected to the main control unit 250. The optical sensor 182 has the same configuration as the optical sensor 181, and outputs a signal corresponding to the brightness of light (the amount of light) received by the light-receiving element. A detailed description of the optical sensor 182 will be omitted.

Figure 13:
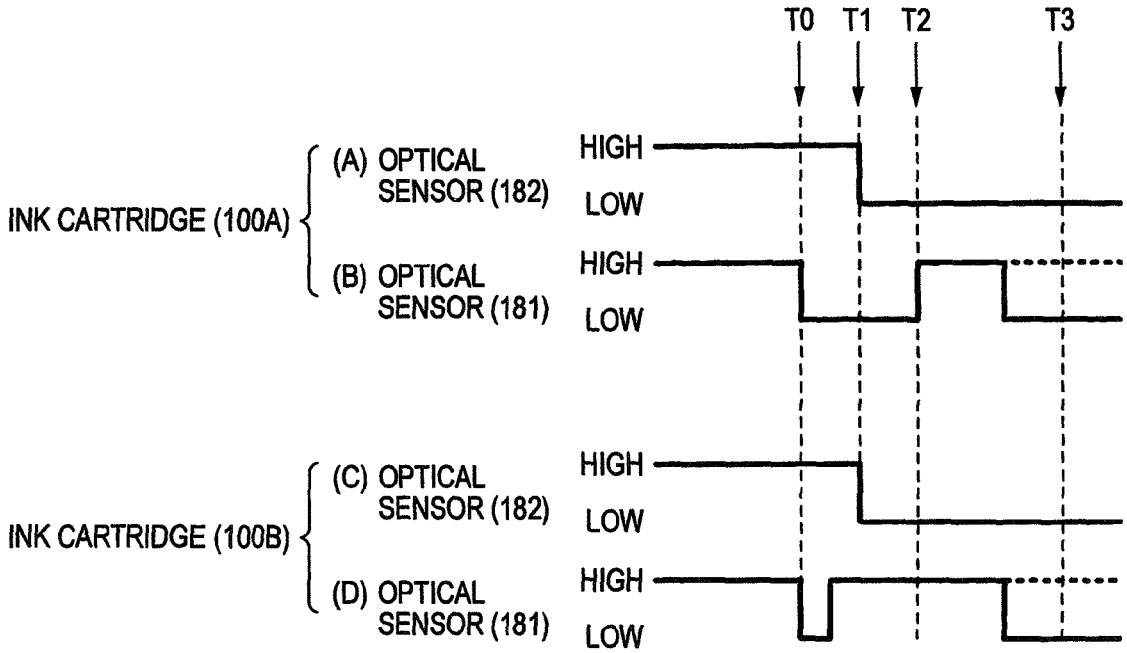
FIG. 13 is a timing chart illustrating time-series waveforms indicating the signal levels of optical sensors according to an exemplary embodiment.

Next, a variation in the levels of the signals output from the optical sensor 181 and the optical sensor 182 when the ink cartridge 100 is inserted will be described with reference to FIG. 13. FIG. 13 is a timing chart illustrating time-series waveforms indicating the levels of the signals output from the optical sensor 181 and the optical sensor 182. In FIG. 13, (A) and (B) show time-series waveforms when the ink cartridge 100A is inserted. Specifically, in FIG. 13, (A) shows the waveform of the signal output from the optical sensor 182, and (B) shows the waveform of the signal output from the optical sensor 181. In FIG. 13, (C) and (D) show time-series waveforms when the ink cartridge 100B is inserted. Specifically, in FIG. 13, (C) shows the waveform of the signal output from the optical sensor 182, and (D) shows the waveform of the signal output from the optical sensor 181.

As shown in (A) and (C) of FIG. 13, when either of the ink cartridges 100A and 100B is inserted into the cartridge mounting portion 202, the optical sensor 182 outputs the same signal waveform. That is, when the detected portion 186 enters the optical path 184 of the optical sensor 182 to shield light, at a time T1, the signal level is changed from a high level to a low level.

When the ink cartridges 100A is inserted into the cartridge mounting portion 202, the bridge portion 189 enters the optical path 183 before the detected portion 186 enters the optical path 184. In this way, light traveling through the optical path 183 is shielded (time T0 in (B) of FIG. 13). In this case, the signal level of the optical sensor 181 is changed from a high level to a low level. Since the bridge portion 189 has the side wall 191, the time required to shield light is relatively long. In this exemplary embodiment, at the time T1, the side wall 191 enters the optical path 184. Therefore, at the time T1, the signal level of the optical sensor 181 is maintained at the low level (see (B) of FIG. 13).

Then, when the ink cartridge 100A is further inserted in the depth direction, at a time T2, the side wall 191 becomes out of the optical path 183, and the opening 190 (see FIG. 3) enters the optical path 183. At this time, the signal level of the optical sensor 181 returns from the low level to the high level. When the insertion of the ink cartridge 100A into the cartridge mounting portion 202 is completed, the opening 190 and the detecting portion 140 enter the optical path 183 (time T3 in (B) of FIG. 13). That is, at the time T3, it is possible to detect the movement of the indicator 72 in the vertical direction in the space 142 of the detecting portion 140. In (B) of FIG. 13, the signal level when the indicator 72 of the arm 70 enters the optical path 183 is represented by a solid line (low level), and the signal level when the indicator 72 is out of the optical path 183 is represented by a dashed line (high level).

Meanwhile, when the ink cartridges 100B is inserted into the cartridge mounting portion 202, the bridge portion 199 enters the optical path 183 to shield light before the detected portion 186 enters the optical path 184 (time T0 in (D) of FIG. 13). In this case, the signal level of the optical sensor 181 is changed from a high level to a low level. Since the bridge portion 199 is a thin plate member, the time required to shield light is shorter than that when the bridge portion 189 enters the optical path. In this exemplary embodiment, at least before the time T1, the bridge portion 189 is out of the optical path 183, and at the time T1, the opening 197 (see FIG. 6) enters the optical path 183. Therefore, at the time T1, the signal level of the optical sensor 181 returns from the low level to the high level (see (D) of FIG. 13).

Then, when the ink cartridge 100B is further inserted in the depth direction, the opening 197 enters the optical path 183. When the insertion of the ink cartridge 100B into the cartridge mounting portion 202 is completed, the opening 197 and the detecting portion 140 enter the optical path 183 (time T3 in (D) of FIG. 13). That is, at the time T3, it is possible to detect the movement of the indicator 72 in the vertical direction in the space 142 of the detecting portion 140. In (D) of FIG. 13, the signal level when the indicator 72 enters the optical path 183 is represented by a solid line (low level), and the signal level when the indicator 72 is out of the optical path 183 is represented by a dashed line (high level).

Figure 14:
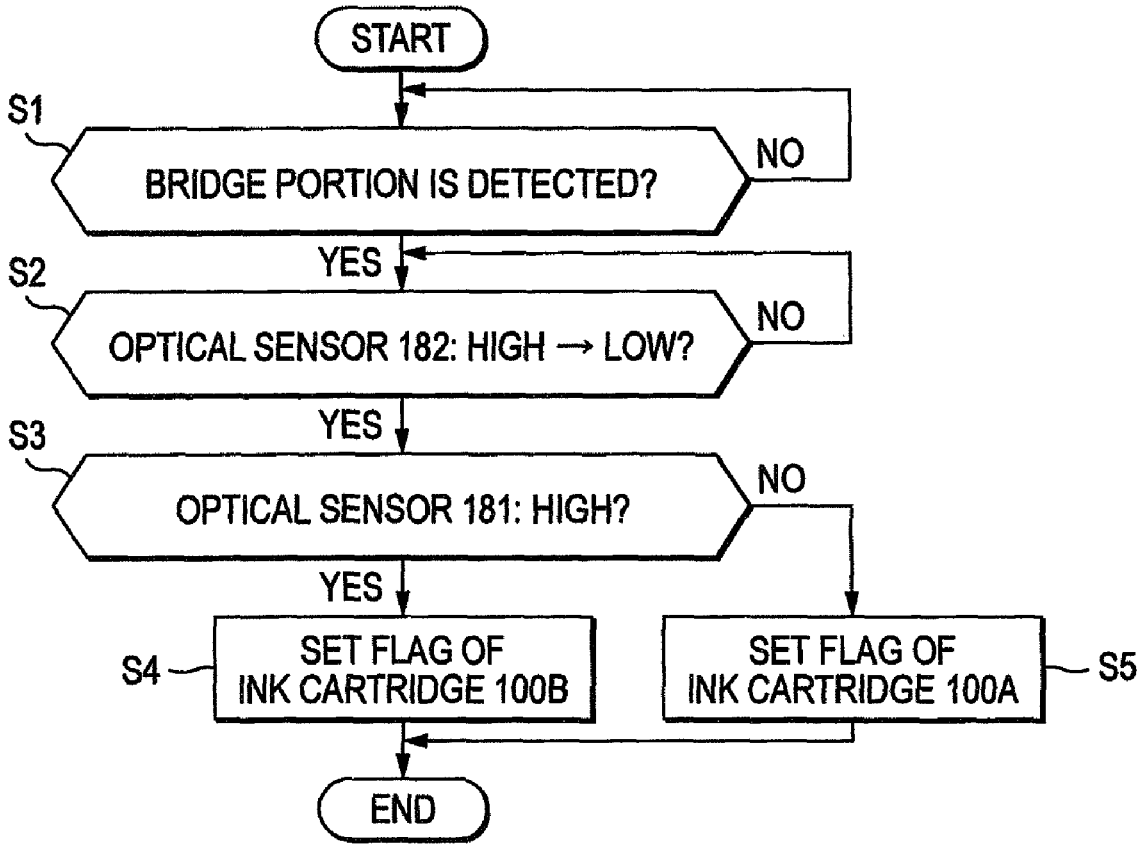
FIG. 14 is a flowchart illustrating an example of a kind determining process performed by the main control unit.

In this exemplary embodiment, the main control unit 250 determines the kind of ink cartridge 100 inserted into the cartridge mounting portion 202 on the basis of the sensor signals of the optical sensors 181 and 182. Next, a kind determining process of determining whether the ink cartridge 100 inserted into the cartridge mounting portion 202 is the ink cartridge 100A or the ink cartridge 100B will be described with reference to the flowchart shown in FIG. 14. FIG. 14 is a flowchart illustrating an example of the kind determining process performed by the main control unit 250.

First, in operation S1, when the ink cartridge 100 is inserted, the main control unit 250 determines whether the bridge portion (189 or 199) is detected. This determining process is performed on the basis of whether the optical path 183 of the optical sensor 181 is blocked. Specifically, this determining process is performed on the basis of whether the signal level of the optical sensor 181 is changed from a high level to a low level (see the time T0 in (B) and (D) of FIG. 13). If it is determined that the bridge portion (189 or 199) is detected, that is, the optical path 183 is blocked (Yes in S1), operation S2 is performed. In this exemplary embodiment, in operation S1, the kind determining process is performed only when the bridge portion (189 or 199) is detected.

In operation S2, the main control unit 250 determines whether the signal level of the optical sensor 182 is changed from a high level to a low level. If it is determined in operation S2 that the signal level of the optical sensor 182 is changed from a high level to a low level (Yes in Step S2), it is determined in operation S3 whether the signal level of the optical sensor 181 is at a high level or a low level at the time when the signal level is changed to the low level (time T1 in FIG. 13). For example, referring to FIG. 13, if the signal level is at a high level at the time T1, it is determined that the ink cartridge 100B is inserted into the cartridge mounting portion 202. If the signal level is at a low level at the time T1, it is determined that the ink cartridge 100A is inserted into the cartridge mounting portion 202.

If it is determined in operation S3 that the signal level of the optical sensor 181 is at a high level (Yes in operation S3), a bit flag indicating the ink cartridge 100B is set in, for example, a register of the CPU 251 in operation S4. If it is determined in operation S3 that the signal level of the optical sensor 181 is at a low level (No in S3), a bit flag indicating the ink cartridge 100A is set in, for example, the register of the CPU 251 in operation S4. The CPU 251 outputs information corresponding to the set bit flag, that is, information of the ink cartridge 100 inserted into the cartridge mounting portion 202 to, for example, an information processing apparatus (personal computer) connected to the multi-function machine 10 over a network, or the liquid crystal display 27 of the multi-function machine 10. Then, the information processing apparatus or the liquid crystal display 27 receives the information, identifies the kind of ink cartridge 100, and displays the information.

As described above, in the multi-function machine 10, the main control unit 250 performs the kind determining process to determine the kind of ink cartridge 100 inserted into the base unit 200. However, the kind determining process can be performed only when the ink cartridge 100 is inserted after the multi-function machine 10 is started up. That is, the main control unit 250 cannot monitor a variation in the signal levels of the optical sensors 181 and 182 when the ink cartridge 100 is inserted in the following case: the ink cartridge 100 is replaced with a new one when the multi-function machine 10 is in an off state due to, for example, cut-off of power supply (for example, when the supply of power is cut off or when the system is in an off state), and then the power is turned on to restart the multi-function machine 10. Therefore, it is not possible to determine the kind of ink cartridge 100 after replacement. In this case, the main control unit does not recognize the replacement of the kind of ink cartridge 100. The recognition error makes it difficult to correctly perform various processes based on the kind of ink cartridge 100.

For example, various processes based on the kind of ink cartridge 100 include a process of recognizing a difference between the ink capacity of the ink cartridge 100A storing a large amount of ink at the beginning and the ink capacity of the ink cartridge 100B storing a standard amount of ink at the beginning and displaying the remaining amount of ink on a user terminal. The remaining amount of ink is a difference between the initial amount of ink and the amount of ink consumed. In addition, the processes include a process of recognizing the difference between ink materials when black inks are made of different ink materials and changing an ink discharge control method according to the ink materials. Further, the processes include a process of recognizing the difference between ink colors and changing an ink discharge control method according to the ink colors.

Figure 15:
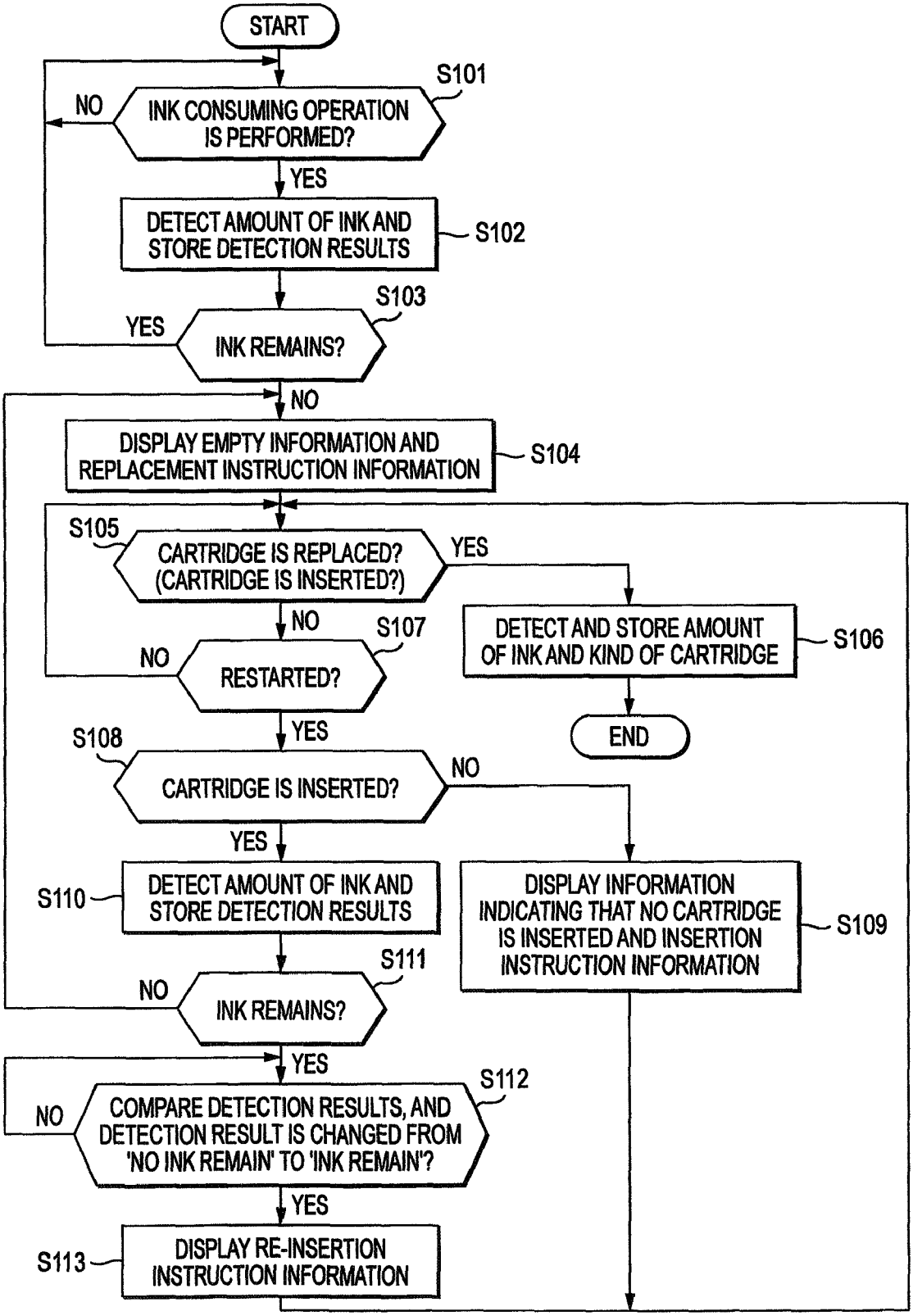
FIG. 15 is a flowchart illustrating an example of a process of displaying re-mounting instruction information performed by the main control unit.

In the multi-function machine 10 according to this exemplary embodiment, when the multi-function machine 10 is started up, re-insertion (re-mount) instruction information is displayed, which will be described below. In this way, even when the ink cartridge 100 is replaced while the multi-function machine 10 is turned off, it is possible to prompt the user to insert the ink cartridge again. Next, a process of displaying the re-insertion instruction information will be described with reference to the flowchart show in FIG. 15. FIG. 15 is a flowchart illustrating the process of displaying the re-insertion instruction information performed by the main control unit 250.

First, in operation S101, the main control unit determines whether an ink consuming operation is performed. Examples of the ink consuming operation include a printing operation and a purge operation. It is possible to determine whether the printing operation or the purge operation is performed on the basis of whether an operation instruction is input.

If it is determined that the ink consuming operation is performed (Yes in S101), a process of detecting the amount of ink in the ink chamber 102 is performed in operation S102. The detecting process is performed on the basis of the signal level of the optical sensor 181. Then, the detection results are stored in the EEPROM 254. For example, when the detected amount of ink is equal to or more than a threshold value, a detection result indicating that 'ink remains' is stored. When the detected amount of ink is less than the predetermined value, a detection result indicating that 'no ink remains' is stored.

Then, it is determined in the next operation S103 whether the detection result obtained in operation S102 indicates 'ink remains' or 'no ink remains'. If the detection result indicates 'no ink remains' (No in S103), information indicating that no ink remains (empty information) and information indicating that the ink cartridge 100 needs to be replaced (replacement instruction information) are output to the liquid crystal display 27 in operation S104. In this way, the information is displayed on the liquid crystal display 27. The information may be output to an information processing apparatus, such as a personal computer, connected to the multi-function machine 10 over a network. When the detection result indicates 'ink remains' (Yes in S103), the processes after operation S101 are repeatedly performed.

It is determined in the next operation S105 whether the ink cartridge 100 is replaced. That is, it is determined whether removing or inserting operation is performed. Since operation S105 is performed by the main control unit 250, the determining process is performed while the multi-function machine 10 is being operated. The determining process is performed on the basis of a variation in the signal level of the optical sensor 182.

When the ink cartridge 100 is replaced (Yes in S105), in operation S106, the main control unit determines the kind of ink cartridge 100 when the ink cartridge 100 is inserted (see FIG. 14), and also determines whether the amount of ink is a threshold value or more. In this exemplary embodiment, the main control unit determines whether the inserted ink cartridge is the large capacity ink cartridge 100A or the standard ink cartridge 100B. The determination results are stored in the RAM 253. In this way, a series of processes is completed.

On the other hand, when the ink cartridge 100 is not replaced (No in S105), it is determined in operation S107 whether the multi-function machine 10 is restarted. When the multi-function machine 10 is restarted without replacing the ink cartridge 100 (Yes in S107), it is determined in operation S108 whether the ink cartridge 100 is inserted during the restart processing, specifically, immediately after the multi-function machine finishes the restart processing. That is, it is determined whether the ink cartridge 100 is inserted into (mounted on) the cartridge mounting portion 202. The determining process is performed on the basis of the signal level of the optical sensor 182. If it is determined that the ink cartridge 100 is not inserted (No in S108), information indicating that the ink cartridge 100 is not inserted (non-insertion information) and information instructing to insert a new ink cartridge 100 (insertion instruction information) are output to the liquid crystal display 27 in operation S109. The information may be output to an information processing apparatus, such as a personal computer, connected to the multi-function machine 10 over a network. When the multi-function machine 10 is not restarted (No in S107), the processes after operation S105 are repeatedly performed.

If it is determined in operation S108 that the ink cartridge 100 is inserted (mounted) (Yes in S108), the same process as that in operation S102 is performed in operation S110. That is, the main control unit detects the amount of ink in the ink chamber 102 in operation S110. The detection results are stored in the RAM 253. Then, the same process as that in operation S103 is performed in operation S111. That is, the main control unit determines whether the detection result obtained in operation S110 indicates 'ink remains' or 'no ink remains'.

If it is determined in operation S111 that the detection result indicates 'no ink remains' (No in S111), the processes after operation S104 are repeatedly performed. On the other hand, if it is determined in operation S111 that the detection result indicates 'ink remains' (Yes in S111), in operation S112, the main control unit compares the detection result stored in the EEPROM 254 in operation S102 with the detection result stored in operation S110. That is, the main control unit compares the detection result stored in the EEPROM 254 before restart with the detection result after restart. Specifically, the main control unit compares the former detection result with the latter detection result to determine whether the detection result is changed from 'no ink remains' to 'ink remains'. This determining process makes it possible to determine whether the ink cartridge 100 is replaced while the multi-function machine 10 is in an off state. That is, it is possible to determine whether the ink cartridge 100 is replaced with a new one on the basis of a change of the detection result from 'no ink remains' to 'ink remains'.

If the detection results are not same with each other in operation S112, that is, if it is determined that the detection result is changed from 'no ink remains' to 'ink remains' (Yes in S112), in the next operation S113, information instructing to re-insert the ink cartridge 100 (re-insertion instruction information) is output to the liquid crystal display 27. This re-insertion instruction information may be output to an information processing apparatus, such as a personal computer, connected to the multi-function machine 10 over a network. Then, the processes after operation S104 are repeatedly performed.

As described above, since the re-insertion instruction information is displayed on the liquid crystal display 27 or the information processing apparatus, it is possible to prompt the user to insert the ink cartridge 100 again. When the user inserts the ink cartridge 100 while the multi-function machine 10 is being operated according to the re-insertion instruction information, it is possible to determine the kind of ink cartridge 100 when the ink cartridge is inserted again.

In this exemplary embodiment, it is possible to determine whether the ink cartridge 100 is the large capacity ink cartridge 100A or the standard ink cartridge 100B. In the multi-function machine 10, information (ink level information) indicating the remaining amount of ink is generated according to the determined kind of ink cartridge, and the ink level information is output to the liquid crystal display 27 or an external information processing apparatus.

Figure 16:
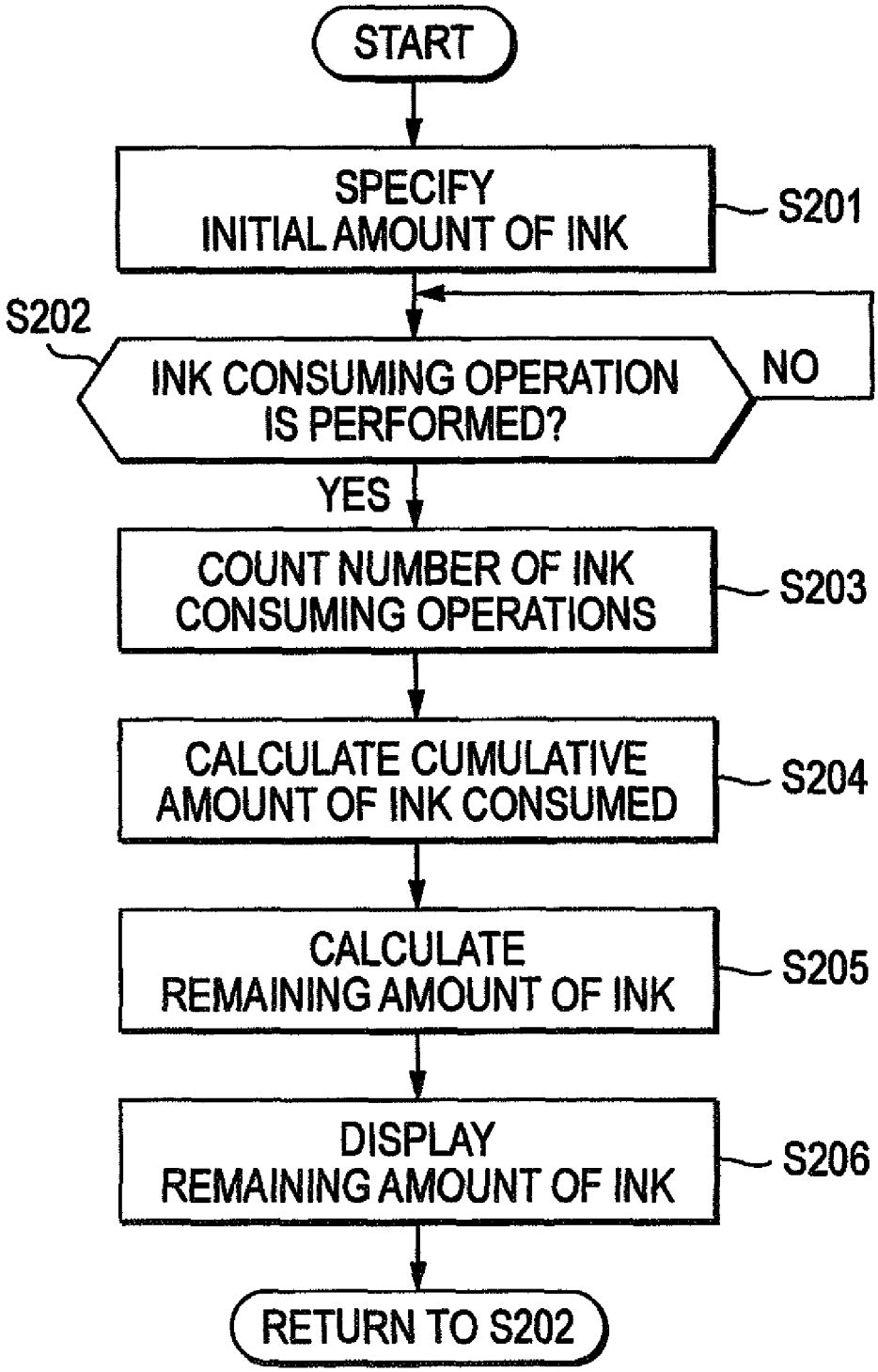
FIG. 16 is a flowchart illustrating an example of a process of outputting ink level information performed by the main control unit.

Specifically, a process of outputting the ink level information will be described with reference to the flowchart shown in FIG. 16. FIG. 16 is a flowchart illustrating an example of the process of outputting the ink level information performed by the main control unit 250. In operation S201, when the ink cartridge 100 is replaced, first, the main control unit specifies the initial amount of ink corresponding to the kind of ink cartridge 100 determined in operation S106. For example, table data indicating initial capacities corresponding to the ink cartridges 100A and 100B is stored in the EEPROM 254 in advance, and the main control unit specifies the initial capacity of the inserted ink cartridge 100 on the basis of the table data.

Then, the main control unit determines whether an ink consuming operation is performed in operation S202. If it is determined that the ink consuming operation is performed (Yes in S202), the main control unit counts the number of ink consuming operations, and stores the count result in a counter memory (not shown) in operation S203. Then, the main control unit calculates the amount of consumption corresponding to the count value stored in the counter memory in operation S204. Subsequently, the main control unit subtracts the amount of consumption calculated in S204 from the initial capacity in operation S205, and outputs the calculated result as the remaining amount of ink to the liquid crystal display 27 or an external information processing apparatus in operation S206.

As described above, in this exemplary embodiment, it is possible to reliably check the initial amount of ink in the ink chamber 102 on the basis of the kind of ink cartridge 100. Therefore, it is possible to accurately calculate the remaining amount of ink on the basis of the initial amount of ink and accurately display the remaining amount of ink.

Further, in the above-described exemplary embodiment, the main control unit 250 performs the kind determining process, the process of outputting and displaying the re-insertion instruction information, and the process of displaying the remaining amount of ink. However, for example, a logic circuit or an IC having various electronic parts capable of performing the processes incorporated thereinto may be used. In addition, in the above-described exemplary embodiment, the main control unit identifies two kinds of ink cartridges, that is, the ink cartridge 100A and the ink cartridge 100B. However, for example, as a modification of the exemplary embodiment, the main control unit may determine the kind of specific ink cartridge from three or more kinds of ink cartridges 100. Further, in a recording apparatus including a black pigment ink cartridge and a black dye ink cartridge, in order to prevent the mixture of different black ink materials and an insertion error, the above-mentioned kind determining process may be applied to discriminate the black pigment ink cartridge from the black dye ink cartridge.

What is claimed is:

1. An image recording apparatus comprising:

a mounting portion configured to mount thereon an ink cartridge;

a first detecting unit which detects an amount of ink in the ink cartridge mounted on the mounting portion;

a storage unit which stores a detection result by the first detecting unit in a storage medium;

a comparing unit which compares a first detection result stored in the storage medium before the image recording apparatus is restarted, with a second detection result obtained by the first detecting unit after the image recording apparatus is restarted; and a first output unit which outputs instruction information to re-mount the ink cartridge based on the comparing unit determining that the first detection result is not the same as the second detection result.

2. The image recording apparatus according to claim 1;

wherein the first detecting unit detects the amount of ink in the ink cartridge, at least one of when an operation of consuming ink in the ink cartridge is performed and when the image recording apparatus is restarted.

3. The image recording apparatus according to claim 1;

wherein the first detecting unit detects whether the amount of ink in the ink cartridge is a threshold value or more; and wherein when the first detection result indicates that the amount of ink is less than the threshold value and the second detection result indicates that the amount of ink is the threshold value or more, the comparing unit determines that the first detection result is not the same as the second detection result.

4. The image recording apparatus according to claim 1;

wherein the first detection result is obtained by the first detecting unit before the image recording apparatus is turned off; and wherein the second detection result is obtained by the first detecting unit when the image recording apparatus is turned off and is started thereafter.

5. The image recording apparatus according to claim 1, further comprising:

a second detecting unit which detects a mounting state of the ink cartridge on the mounting portion;

wherein the first detecting unit detects the amount of ink in the ink cartridge when the second detecting unit detects the mounting of the ink cartridge.

6. The image recording apparatus according to claim 1, further comprising:

a third detecting unit which detects a kind of the ink cartridge while the ink cartridge is being mounted on the mounting portion.

7. The image recording apparatus according to claim 6;

wherein the third detecting unit detects an initial amount of ink in the ink cartridge.

8. The image recording apparatus according to claim 7, further comprising:

a calculating unit which calculates the amount of ink after an ink consuming operation based on the initial amount of ink detected by the third detecting unit; and a second output unit which outputs the amount of ink calculated by the calculating unit.

9. The image recording apparatus according to claim 3;

wherein the comparing unit determines whether an ink cartridge mounted at a time of the detection of the first detection result is different from an ink cartridge mounted at a time of the detection of the second detection result, based on the comparison between an amount of ink of the first detection result and an amount of ink of the second detection result.

10. The image recording apparatus according to claim 6;

wherein the first output unit outputs instruction information to re-mount the ink cartridge for detecting a kind of the ink cartridge based on the comparing unit determining that the first detection result is not the same as the second detection result.

11. An information output method comprising:

detecting an amount of ink in an ink cartridge which is removably mountable on an image recording apparatus;

storing the detected amount of ink in a storage medium;

comparing a first detection result stored in the storage medium before the image recording apparatus is restarted, with a second detection result obtained at the detecting step after the image recording apparatus is restarted; and outputting instruction information to re-mount the ink cartridge based on a determination that the first detection result is not the same as the second detection result.

* * * * *